US005797597A

United States Patent [19]

Kakuta et al.

[11] Patent Number: 5,797,597

[45] Date of Patent: Aug. 25, 1998

[54] AUTOMATIC DOCUMENT CONVEYING DEVICE

[75] Inventors: Masayuki Kakuta; Yoshiaki Tabata, both of Osaka, Japan

[73] Assignee: Mita Industrial Co., Ltd., Osaka, Japan

[21] Appl. No.: 731,584

[22] Filed: Oct. 17, 1996

[30] Foreign Application Priority Data

| | | | |
|---|---|---|---|
| Nov. 14, 1995 | [JP] | Japan | 7-295442 |
| Nov. 14, 1995 | [JP] | Japan | 7-295443 |
| Dec. 19, 1995 | [JP] | Japan | 7-330293 |
| Feb. 6, 1996 | [JP] | Japan | 8-019221 |
| Feb. 6, 1996 | [JP] | Japan | 8-019222 |
| Feb. 6, 1996 | [JP] | Japan | 8-019223 |

[51] Int. Cl.[6] ..... B65H 3/12

[52] U.S. Cl. ..... 271/96; 271/276; 271/108; 271/197

[58] Field of Search ..... 271/20, 94, 99, 271/108, 96, 171, 248, 227, 265.01, 265.03, 276, 197, 12, 110, 111

[56] References Cited

U.S. PATENT DOCUMENTS

| | | | |
|---|---|---|---|
| 3,321,121 | 5/1967 | Nyberg et al. | 271/197 |
| 3,386,574 | 6/1968 | Kaplan | 271/276 |
| 3,942,787 | 3/1976 | Bolza-Schunemann | 271/276 |
| 4,268,023 | 5/1981 | Anderson | 271/94 |
| 5,037,079 | 8/1991 | Siegel et al. | 271/276 |
| 5,108,083 | 4/1992 | Russel et al. | 271/276 |
| 5,322,012 | 6/1994 | Gartner et al. | 271/227 |
| 5,501,447 | 3/1996 | Haupenthal | 271/276 |

FOREIGN PATENT DOCUMENTS

| | | | |
|---|---|---|---|
| 60-12450 | 1/1985 | Japan | 271/276 |

*Primary Examiner*—William E. Terrell
*Assistant Examiner*—Patrick Mackey
*Attorney, Agent, or Firm*—Beveridge, DeGrandi, Weilacher & Young, LLP

[57] ABSTRACT

An automatic document conveying device comprises a document table on which documents are placed; a vacuum separating/feeding means for feeding the set documents placed on the document table; a set document stopper for positioning the front ends of the documents placed on the document table; and a discharged document stopper for restraining the movement of the document discharged onto the set documents after being fed by the vacuum feeding means and subjected to image processing. A first opening and a second opening are provided in the document table. The vacuum separating/feeding means is disposed below the first opening. A feed drum connected to the vacuum chamber of the vacuum separating/feeding means via an opening/closing means is disposed below the second opening.

4 Claims, 12 Drawing Sheets

11
302
30
301
266
262
24
692b
692a
261
26
32
264
28
282
281
742
741
74
72
701
702
693
622
682
632
681
631
667
691c
66
663
661
662
65
691
691b
666
694
692a
692b
692
692
64
67
664
691a
63
621
62
623

11
65
66
661
662
663
666
667
631
632
621
62
623
64
67
692a
691b
692b
692
692
692b
692a
691c
261
694
63
691a
691
693
262
24
26
32
264
28
281
282
701
702
681
682
683
622
664
302
30
301
266
742
741
72
74

AUTOMATIC DOCUMENT CONVEYING DEVICE

FIELD OF THE INVENTION

This invention relates to an automatic document conveying device to be mounted on a document processor such as an electrostatic copying machine. More specifically, the invention relates to a so-called circulation type automatic document conveying device constructed such that set documents placed on a document table are fed one by one, subjected to image processing, and then discharged onto the set documents from the upstream side of the document table in the document conveying direction.

DESCRIPTION OF THE PRIOR ART

In recent years, with the speeding and automation of copying, copying machines have used an automatic document conveying device which automatically feeds a plurality of documents successively to a document setting position on the top of a transparent panel. As such an automatic document conveying device, a so-called circulation type one has been put to practical use in which set documents placed on a document table are fed one by one, image-processed, and then discharged onto the set documents from the upstream side of the document table in the document conveying direction. The circulation type automatic document conveying device is disclosed, for example, in Japanese Laid-Open Patent Publication No. 282029/88, and comprises a document table for bearing documents; a document separating/feeding mechanism for separating and feeding the lowermost document of the set documents placed on the document table; a set document stopper for positioning the front end of the document placed on the document table; and a discharged document stopper disposed on the upstream side of the set document stopper in the document conveying direction and restraining the movement of the document that has been fed by the document separating/feeding mechanism, image-processed, and then discharged onto the set documents. The document separating/feeding mechanism in customary use is composed of a feed roller having a plurality of rollers which are disposed below a guide plate disposed ahead of the document table in the conveying direction and which protrude upwards through an opening formed in the guide plate; and a separating belt mechanism disposed above the feed roller to oppose the feed roller. This type of document separating/feeding mechanism causes a high frictional force between the lowermost document and the second lowest document when separating the lowermost document from the second lowest document. If the lowermost document contains descriptions written with a writing tool, such as a pencil, which gives a writing easily erasable upon frictional contact, the back of the second lowest document is stained by the lowermost document.

As a document separating/feeding means for solving the above-described problem, Japanese Laid-Open Patent Publication Nos. 56443/81 and 93141/87, for instance, each disclose a document separating/feeding mechanism for an automatic document conveying device, the document separating/feeding mechanism comprising a document table having an opening at a front part thereof in the document conveying direction; and a vacuum separating/feeding means including a vacuum chamber disposed below the opening of the document table and having an opening at an upper surface thereof, a drive roller and a driven roller disposed parallel to each other ahead of and behind the vacuum chamber in the document conveying direction, and a feed belt passed over the drive roller, the driven roller and the vacuum chamber and having a plurality of holes; wherein the lowermost document of documents placed on the document table is fed while being suction-attached to the feed belt.

On the document table, a regulating member is disposed for regulating the widthwise position of the document placed on the document table. Within the range of movement of this width regulating member, the vacuum feeding means cannot be disposed. In a document separating/feeding mechanism in which a document is set based on the farthest (deepest) side of the document table, therefore, the vacuum feeding means is disposed on the farthest side of the document table. With this positioning of the vacuum feeding means on the farthest side of the document table, if a large document is fed, nearly a half of the document on the document table is suction-attached to the vacuum feeding means, whereas the remaining nearly half of the document is not suction-attached to the vacuum feeding means, but remains free, causing an oblique feed of the document.

The document separating/feeding mechanism for an automatic document conveying device disclosed in each of the aforementioned publications also involves a technique of sending air between the lowermost, first document and the second or later documents in order to ensure the separation of the lowermost, first document from the second or later documents among the documents placed on the document table. According to this technique, a so-called air knife is provided for jetting air to a front end part, in the document conveying direction, of the document placed on the document table. To feed air, jetted by the air knife, efficiently into a gap between the lowermost, first document and the second or later document, Japanese Laid-Open Patent Publication No. 93141/87 discloses a structure in which a rib extending in the conveying direction is provided in the opening provided in the document table, and the entire feed belt is deformed in wavy form along the rib by the suction of the vacuum chamber.

However, the rib provided in the opening is formed in a straight line in the document conveying direction. If the second document is not completely floated by air, the lowermost, first document being conveyed, and the second document are rubbed at the site of the rib, causing stain to the document. Since the feed belt and the rib make contact only at a particular site, moreover, early wear of the feed belt may occur.

A so-called circulation type automatic document conveying device also goes into practical use in which a document fed by the document separating/feeding mechanism is conveyed onto a transparent panel, subjected to exposure on the transparent panel, and then returned onto documents set on the document table so as to be treated repeatedly.

If the documents set on the document table are a few, there may be no documents set on the document table, when the lowermost, first document has been fed by the document separating/feeding mechanism, exposed, and then discharged onto the document table. In this case, the front end of the document may be engaged with the rubber feed belt constituting the vacuum document separating/feeding mechanism, thereby causing a fold of the document, or even a jam.

The vacuum separating/feeding means constituting the document separating/feeding mechanism also includes a separating air jetting means for jetting air toward the front ends of documents placed on the document table to inject air between adjacent documents of the set documents, thereby performing document separation. This separating air jetting means adjusts the amount of injected air according to the volume of the set documents placed on the document table. That is, the weight of the set documents placed on the document table varies with the load of the set documents. Thus, the amount of injected air should desirably be adjusted according to the volume of the documents set on the document table. For this purpose, there is need to provide a document load detecting means for detecting the load of documents set on the document table. An automatic document conveying device has become practical in which the detector portion of such a document load detecting means is placed on the set documents on the upstream side of the discharged document stopper in the document conveying direction.

If the document is paper with relatively high nerve, the document discharged from the document discharge portion moves toward the discharged document stopper, with the front end of the document passing above the detector portion of the document load detecting means. If the document is a thin paper with weak nerve, the document is downwardly bent immediately after discharge from the document discharge portion. Before reaching the discharged document stopper, the front end of the document contacts the detector portion of the document load detecting means and bends, causing poor stock or jam.

The following problem has also been involved, although it does not always face an automatic document conveying device equipped with a vacuum separating/feeding means: The set document stopper needs to be brought to a stop position for positioning the front ends of documents placed on the document table when setting the documents. At the time of image processing, the set document stopper needs to be moved to a retreat position where the stopper has retreated from the document table. The discharged document stopper, on the other hand, needs to be moved to a retreat position where the stopper has retreated from the document table, when the documents are to be set. At the time of image processing, the discharged document stopper should be brought to a restraint position where the stopper contacts the set documents on the document table. With a conventional automatic document conveying device, however, the set document stopper is disposed below the document table, while the discharged document stopper is disposed above the document table, so that the set document stopper and the discharged document stopper are moved by separate moving means. Thus, two each of driving means and moving mechanisms, such as a solenoid or an electric motor, are required, making the whole apparatus expensive.

An automatic document conveying device with vacuum separating/feeding means also includes a separating air jetting means for jetting air toward the front ends of set documents placed on the document table to inject air between adjacent documents of the set documents, thereby performing document separation. This separating air jetting means adjusts the amount of injected air according to the volume of the set documents placed on the document table. That is, the weight of the set documents placed on the document table varies with the load of the set documents. Thus, the amount of injected air should desirably be adjusted according to the volume of the documents set on the document table. However, the detector portion of the document load detecting means for detecting the load of documents set on the document table is placed on the set documents on the document table during image processing, but must be retreated from the document table during document setting. Thus, moving means for moving the detector portion of the document load detecting means is required. However, the detector portion of the document load detecting means may take nearly the same action as does the discharged document stopper, and thus should desirably be moved by stopper moving means.

In the vacuum separating/feeding means constituting the document separating/feeding mechanism, when air is jetted by the separating air jetting means to the front ends of the documents placed on the document table, air is injected between adjacent documents. At the front end parts of the documents, the second and later documents are floated and separated from the lowermost, first document. At the central parts to the rear ends of the documents, by contrast, the respective documents are kept in contact, since the air is not injected. Hence, when the lowermost, first document is suction-attached to and fed by the feed belt of the vacuum separating/feeding means, the second and later documents are also dragged and fed by a frictional force due to the contact, a phenomenon which may be called dragged overlap feed. To prevent this dragged overlap feed of the second or later document during feeding of the lowermost, first document, a document separating member may be disposed at a front end part of the document table with a slight spacing from the top of the document table. Provision of this document separating member would increase the number of parts, adding to costs and requiring more space to dispose the document separating member.

SUMMARY OF THE INVENTION

A first object of this invention is to provide a document separating/feeding mechanism for an automatic document conveying device, the document separating/feeding mechanism being capable of feeding a large document while suction-attracting the widthwise whole of the document under vacuum.

A second object of the invention is to provide a document separating/feeding mechanism for an automatic document conveying device, constructed such that a rib provided in an opening formed in a vacuum chamber of a vacuum separating/feeding means, and a feed belt constituting the vacuum separating/feeding means make no contact at a particular site.

A third object of the invention is to provide an automatic document conveying device capable of smoothly discharging the lowermost, first document, which has been set on the document table, fed, and exposed, even in the absence of documents on the document table.

A fourth object of the invention is to provide an automatic document conveying device capable of preventing the front end of the document, which is discharged from the document discharge portion, from contacting the detector portion of the document load detecting means before reaching the discharged document stopper.

A fifth object of the invention is to provide a less expensive automatic document conveying device adapted to move the set document stopper and the discharged document stopper by a single moving means.

A sixth object of the invention is to provide an even less expensive automatic document conveying device adapted to move the detector portion of the document load detecting means as well as the set document stopper and the discharged document stopper by the moving means which moves these stoppers.

A seventh object of the invention is to provide a less expensive automatic document conveying device having a dragged overlap feed preventing function by imparting the function of a document separating member to the set document stopper which positions the front end of the document placed on the document table.

To attain the first object, the present invention provides a document separating/feeding mechanism for an automatic document conveying device, the document separating/feeding mechanism comprising:

a document table having a first opening at a front part thereof in the document conveying direction, and a vacuum separating/feeding means including a vacuum chamber disposed below the first opening of the document table such that an upper surface thereof is nearly coplanar with the upper surface of the document table, the upper surface of the vacuum chamber having an opening; a drive roller and a driven roller disposed parallel to each other ahead of and behind the vacuum chamber in the document conveying direction; and a feed belt passed over the drive roller, the driven roller and the vacuum chamber and having a plurality of holes; wherein the document table has a second opening laterally of a front part of the first opening in the document conveying direction, and the document separating/feeding mechanism further includes a feed drum disposed below the second opening of the document table such that an outer peripheral surface thereof is situated slightly above the upper surface of the document table; a driving means for rotationally driving the feed drum at nearly the same peripheral speed as the moving speed of the feed belt; a duct for connecting the feed drum and the vacuum chamber; and an opening/closing means for making the vacuum chamber and the feed drum communicate with each other via the duct or cut off from each other.

The present invention also provides a document separating/feeding mechanism for an automatic document conveying device, in which the duct comprises a suction portion to be inserted into the feed drum, and a connecting portion, the suction portion has an opening on an upper side thereof, an upper end side of a side wall constituting the opening adjoins the inner peripheral surface of the feed drum.

The present invention also provides a document separating/feeding mechanism for an automatic document conveying device, the document separating/feeding mechanism further including a document detecting means for detecting whether the document placed on the document table is situated above the second opening or not, in which when the document detecting means detects the document, the opening/closing means establishes communication between the vacuum chamber and the feed drum, whereas when the document detecting means does not detect the document, the opening/closing means cuts off communication between the vacuum chamber and the feed drum.

The present invention also provides a document separating/feeding mechanism for an automatic document conveying device, in which the drive means is provided with an electromagnetic clutch, and when the document detecting means detects the document, the electromagnetic clutch is energized, whereas when the document detecting means does not detect the document, the electromagnetic clutch is deenergized.

To attain the second object, the present invention provides a document separating/feeding mechanism for an automatic document conveying device, the document separating/feeding mechanism comprising:

a document table having an opening at a front part thereof in the document conveying direction, and a vacuum separating/feeding means including a vacuum chamber disposed below the opening of the document table such that the upper surface of the vacuum chamber is nearly coplanar with the upper surface of the document table, the upper surface of the vacuum chamber having an opening; a drive roller and a driven roller disposed parallel to each other ahead of and behind the vacuum chamber in the document conveying direction; and a feed belt passed over the drive roller, the driven roller and the vacuum chamber and having a plurality of holes; wherein a rib is provided in the opening of the vacuum chamber, the rib being disposed obliquely with respect to the document conveying direction and slightly protruding from the upper surface of the vacuum chamber.

To attain the third object, the present invention provides an automatic document conveying device comprising:

a document table having an opening at a front part thereof in the document conveying direction;

a vacuum separating/feeding means including a vacuum chamber disposed below the opening of the document table such that the upper surface of the vacuum chamber is nearly coplanar with the upper surface of the document table, the upper surface of the vacuum chamber having an opening; a feed belt wound round the vacuum chamber and moved in the document conveying direction, the feed belt having a plurality of holes; and a separating air jetting means for jetting air toward the front ends of documents placed on the document table;

a document conveying means for conveying the document, fed by the vacuum separating/feeding means, onto a transparent panel;

a document discharge means for discharging the document on the transparent panel onto the document table;

a feed motor for driving the feed belt of the vacuum separating/feeding means;

a conveying motor for driving the document conveying means;

a discharge motor for driving the document discharge means;

a document detection sensor for detecting whether the document is present on the document table or not; and a control means for driving and controlling the feed motor, the conveying motor and the discharge motor based on a detection signal from the document detection sensor; wherein when the document detection sensor produces a signal for the absence of a document during discharge of the first document by the document discharge means, the control means drives the feed motor to move the feed belt of the vacuum separating/feeding means.

The present invention also provides an automatic document conveying device in which the control means drives and controls the feed motor so that the moving speed of the feed belt becomes nearly equal to the document discharge speed by the document discharge means.

To attain the fourth object, the present invention provides an automatic document conveying device comprising:

a document table having an opening at a front part thereof in the document conveying direction;

a vacuum separating/feeding means including a vacuum chamber disposed below the opening of the document table such that the upper surface of the vacuum chamber is nearly coplanar with the upper surface of the document table, the upper surface of the vacuum chamber having an opening; a feed belt wound round the vacuum chamber and moved in the document conveying direction, the feed belt having a plurality of holes; and a separating air jetting means for jetting air toward the front ends of documents placed on the document table;

a set document stopper for positioning the front ends of the documents placed on the document table;

a discharged document stopper disposed upstream from the set document stopper in the document conveying direction and restraining the movement of the document that is discharged onto the set documents after being fed by the feed means and subjected to image processing; and a document load detecting means for detecting the load of the set documents placed on the document table; wherein the document load detecting means includes a detector member having a detection portion which contacts the set document placed on the document table, the detection portion being disposed between the set document stopper and the discharged document stopper.

To attain the fifth object, the present invention provides an automatic document conveying device comprising:

a document table which documents are placed on;

a feed means for feeding set documents placed on the document table;

a set document stopper for positioning the front ends of the documents placed on the document table;

a discharged document stopper for restraining the movement of the document that is discharged onto the set documents after being fed by the feed means and subjected to image processing; and a stopper moving means for bringing the set document stopper and the discharged document stopper to predetermined positions; wherein the set document stopper is disposed above the document table and is movable between a stop position where the lower end of the set document stopper contacts the upper surface of the document table, and a retreat position where the lower end of the set document stopper retreats upward from the upper surface of the document table, the discharged document stopper is disposed above the document table and upstream from the set document stopper in the document conveying direction, and is movable between a restraint position where the discharged document stopper contacts the set documents, and a retreat position where the discharged document stopper retreats upward of the document table, and the stopper moving means comprises one driving means, and a moving mechanism for moving the set document stopper and the discharged document stopper by the driving force of the driving means; and when moving the set document stopper from the stop position to the retreat position, the stopper moving means moves the discharged document stopper from the retreat position to the restraint position, while when moving the set document stopper from the retreat position to the stop position, the stopper moving means moves the discharged document stopper from the restraint position to the retreat position.

The present invention also provides an automatic document conveying device in which the moving mechanism of the stopper moving means comprises a moving shaft rotated by the driving means through a predetermined angle; a moving cam mounted on the moving shaft and engaging the set document stopper to move the set document stopper; and a moving lever mounted on the moving shaft and engaging the discharged document stopper to move the discharged document stopper.

To attain the sixth object, the present invention provides an automatic document conveying device comprising:

a document table having an opening at a front part thereof in the document conveying direction;

a vacuum separating/feeding means including a vacuum chamber disposed below the opening of the document table such that the upper surface of the vacuum chamber is nearly coplanar with the upper surface of the document table, the upper surface of the vacuum chamber having an opening; a feed belt wound round the vacuum chamber and moved in the document conveying direction, the feed belt having a plurality of holes; and a separating air jetting means for jetting air toward the front ends of documents placed on the document table;

a set document stopper for positioning the front ends of the documents placed on the document table;

a discharged document stopper for restraining the movement of the document that is discharged onto the set documents after being fed by the feed means and subjected to image processing;

a document load detecting means for detecting the load of the set documents placed on the document table; and a stopper moving means for bringing the set document stopper and the discharged document stopper to predetermined positions; wherein the set document stopper is disposed above the document table and is movable between a stop position where the lower end of the set document stopper contacts the upper surface of the document table, and a retreat position where the lower end of the set document stopper retreats upward from the upper surface of the document table, the discharged document stopper is disposed above the document table and upstream from the set document stopper in the document conveying direction, and is movable between a restraint position where the discharged document stopper contacts the set documents, and a retreat position where the discharged document stopper retreats upward of the document table, the document load detecting means includes a detector member disposed above the document table and having a detection portion which contacts the set documents placed on the document table, the detector member being movable between a detection position where the detection portion contacts the set documents, and a retreat position where the detection portion retreats upward of the document table, the stopper moving means comprises one driving means, and a moving mechanism for moving the set document stopper, the discharged document stopper, and the detection portion of the document load detecting means by the driving force of the driving means; and when moving the set document stopper from the stop position to the retreat position, the stopper moving means moves the discharged document stopper from the retreat position to the restraint position and also moves the detection portion of the document load detecting means from the retreat position to the detection position, while when moving the set document stopper from the retreat position to the stop position, the stopper moving means moves the discharged document stopper from the restraint position to the retreat position and also moves the detection portion of the document load detecting means from the detection position to the retreat position.

The present invention also provides an automatic document conveying device in which the moving mechanism of the stopper moving means comprises a moving shaft rotated by the driving means through a predetermined angle; a moving cam mounted on the moving shaft and engaging the set document stopper to move the set document stopper; a moving lever mounted on the moving shaft and engaging the discharged document stopper to move the discharged document stopper; and a moving lever mounted on the moving shaft and engaging the detector member constituting the document load detecting means to move the detector member.

To attain the seventh object, the present invention provides an automatic document conveying device comprising:

a document table having an opening at a front part thereof in the document conveying direction;

a vacuum separating/feeding means including a vacuum chamber disposed below the opening of the document table such that the upper surface of the vacuum chamber is nearly coplanar with the upper surface of the document table, the upper surface of the vacuum chamber having an opening; a feed belt wound round the vacuum chamber and moved in the document conveying direction, the feed belt having a plurality of holes; and a separating air jetting means for jetting air toward the front ends of documents placed on the document table;

a set document stopper for positioning the front ends of the documents placed on the document table; and a stopper moving means for moving the set document stopper; wherein the set document stopper is disposed above the document table and is movable between a stop position where the lower end of the set document stopper contacts the upper surface of the document table, and a document separation position where the lower end of the set document stopper is spaced upward from the upper surface of the document table with a predetermined spacing, and the stopper moving means brings the set document stopper to the stop position when setting documents, and brings the set document stopper to the document separation position when feeding documents.

DETAILED DESCRIPTION OF THE PREFERRED EMBODIMENTS

Preferred embodiments of an automatic document conveying device constructed in accordance with the present invention will be described in detail by reference to the accompanying drawings.

Figure 1:
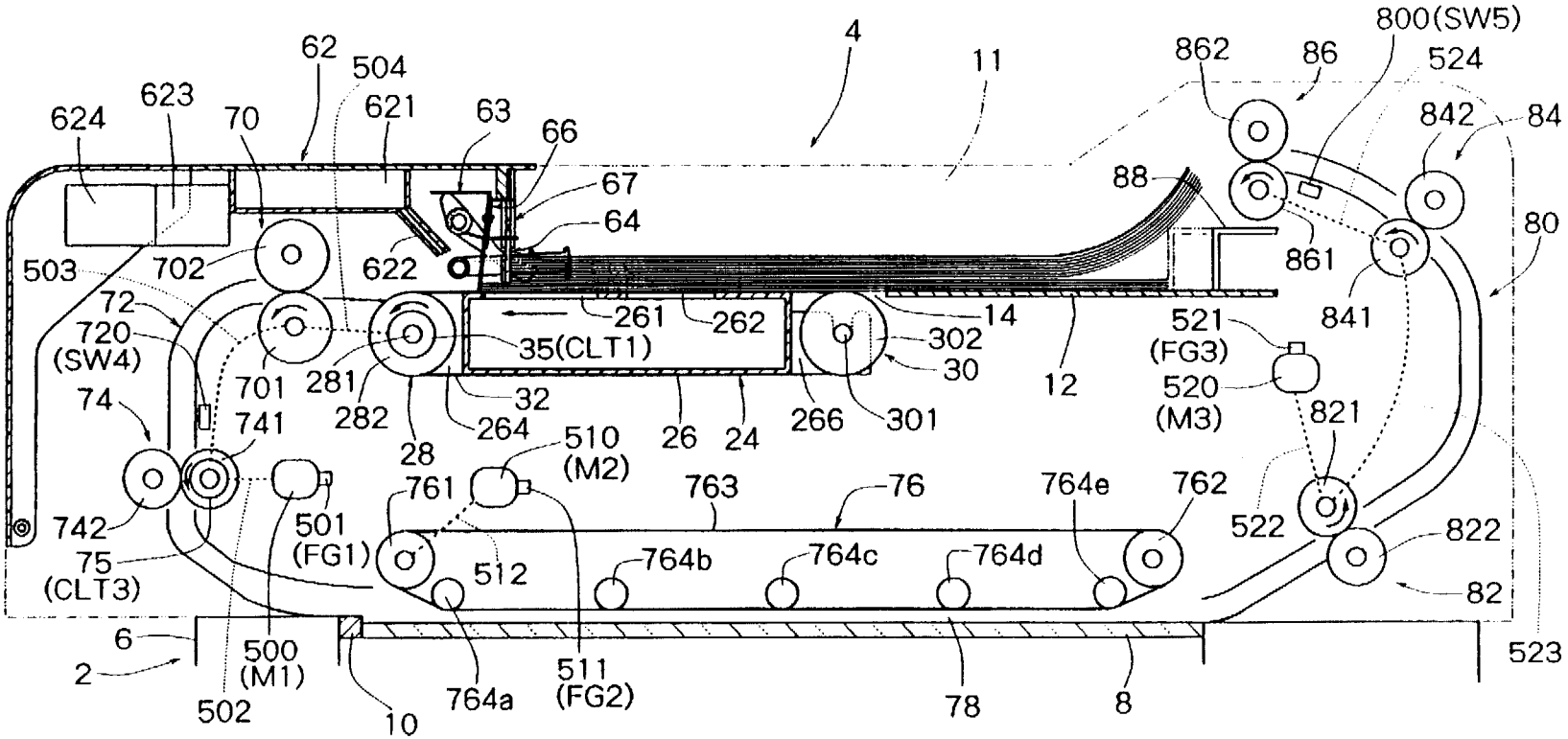
FIG. 1 is a sectional view of an automatic document conveying device constructed in accordance with the present invention.

FIG. 1 illustrate an upper end portion of an electrostatic copying machine 2 and an automatic document conveying device 4 mounted thereon. The electrostatic copying machine 2 has a housing 6, on top of which a transparent panel 8, optionally a glass plate, is disposed. On one side of the transparent panel 8 (the left-hand side in FIG. 1), a document restraining member 10 for determining a standard position for document setting is disposed. The automatic document conveying device 4 constructed in accordance with the present invention is mounted on the top of the housing 6 of the electrostatic copying machine 2 so as to be pivotable about a pivot axis extending along a side edge on the farthest side of the transparent panel 8. If a document is to be laid manually on the transparent panel 8 of the electrostatic copying machine 2, the automatic document conveying device 4 is pivoted upward from the illustrated closed position to the open position to expose the transparent panel 8 to the outside. Then, the document is placed at a required position on the transparent panel 8, and the automatic document conveying device 4 is brought to the illustrated closed position to cover the transparent panel 8 and the document placed thereon. In laying the document on the transparent panel 8, one can set the document at the required position by contacting one edge of the document with the front edge of the document restraining member 10 to bring the one edge of the document to the standard position for document setting. When the automatic document conveying device 4 is used to feed the document automatically onto the transparent panel 8 and force it out automatically from there, the device 4 is put to the closed position.

Figure 2:
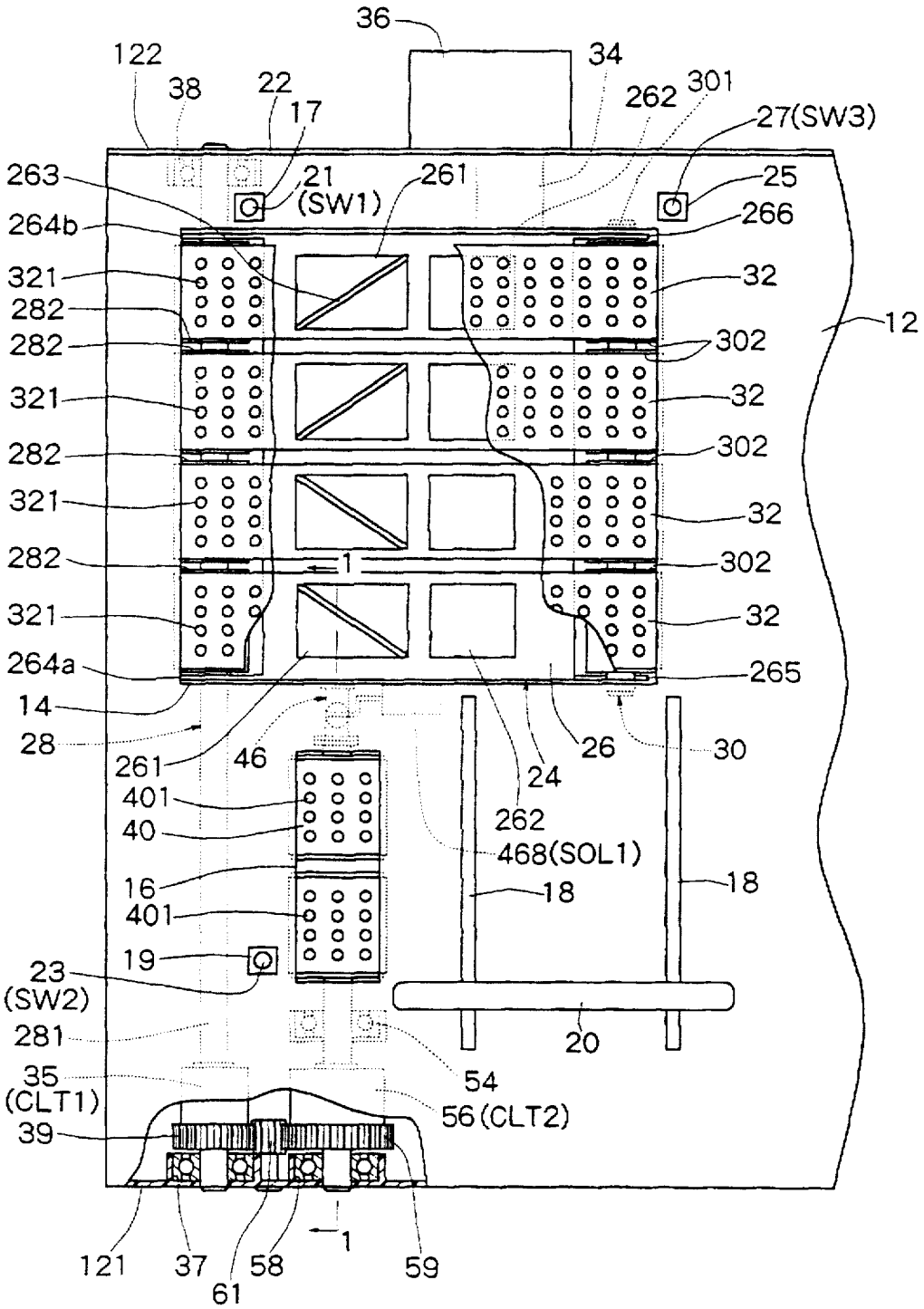
FIG. 2 is an essential part plan view, partly broken away, of a vacuum separating/feeding means mounted on the automatic document conveying device shown in FIG. 1.

Further with reference to FIGS. 1 and 2, the illustrated automatic document conveying device 4 includes a document table 12 as a document placing means disposed between opposite side plates 11 (only the side plate on the farthest side is indicated by a two-dot chain line in FIG. 1) arranged with spacing in a back-and-forth direction (the direction perpendicular to the sheet face in FIG. 1). The document table 12 has a large first opening 14 at a front part in the document conveying direction (the left-hand part in FIGS. 1 and 2) on the farthest side (the upper side in FIG. 2), and a second opening 16 smaller than the first opening 14 at a front part in the document conveying direction (the left side in FIG. 2) on the nearest and lateral side of the first opening 14. In the document table 12, a pair of guide grooves 18, 18 are provided which extend in the width direction behind the second opening 16 in the document conveying direction. The pair of guide grooves 18, 18 are fitted with support legs of a width regulating member 20 for regulating the widthwise position of the document placed on the document table 12. The width regulating member 20 is movable in the up-and-down direction in FIG. 2 along the pair of guide grooves 18, 18. In the automatic document conveying device 4 of the illustrated embodiment, the standard position of the document placed on the document table 12 is on the farthest side (one side only). Thus, the widthwise position of the document placed on the document table 12 is regulated by the inner surface of a side plate 22 formed upright on the farthest side of the document table 12, and the inner surface of the width regulating member 20. On the farthest side in a front end part of the document table 12 in the document conveying direction, a sensor hole 17 is provided. On the lower side of the sensor hole 17, a reflection type first document detecting sensor 21 (SW1) comprising a light emitting element and a light receiving element is disposed. This first document detecting sensor 21 (SW1) detects the document placed on the document table 12, and sends a detection signal to a control means 100 to be described later. In the document table 12, moreover, a sensor hole 19 is provided on the nearest side (the lower side in FIG. 2) of the second opening 16 at a position aligning with the sensor hole 17. On the lower side of the sensor hole 19, a reflection type second document detecting sensor 23 (SW2) comprising a light emitting element and a light receiving element is disposed. The second document detecting sensor 23 (SW2) serves as a document detecting means for detecting whether the widthwise size of the document placed on the document table 12 is larger than the size ranging from the inner surface of the side plate 22 to the second opening 16, namely whether the document placed on the document table 12 is situated on the second opening 16 or not. Then, the second document detecting sensor 23 (SW2) delivers a detection signal to the control means 100 (to be described later). As a document detection signal on whether the document placed on the document table 12 is situated on the second opening 16 or not, there may be used a detection signal from a means which detects the size of the document based on the moving position of the width regulating member 20. Further, the document table 12 is provided with a sensor hole 25 behind the first opening 14 in the document conveying direction. On the lower side of the sensor hole 25, a reflection type third document detecting sensor 27 (SW3) comprising a light emitting element and a light receiving element is disposed. The third document detecting sensor 27 (SW3) detects whether there is a document on the first opening 14 of the document table 12 or not. Then, the third document detecting sensor 27 (SW3) delivers a detection signal to the control means 100 (to be described later).

Below the document table 12, a vacuum separating/feeding means 24 is disposed in alignment with the first opening 14. The vacuum separating/feeding means 24 includes a vacuum chamber 26, a drive roller 28 and a driven roller 30 disposed parallel to each other ahead of and behind the vacuum chamber 26 in the document conveying direction, and four feed belts 32 passed over the drive roller 28, the driven roller 30 and the vacuum chamber 26. The vacuum chamber 26 is formed of a plastic material, and has in its upper wall four openings 261 forwardly in the document conveying direction, and four openings 262 behind the four openings 261 in the document conveying direction. In the four openings 261 formed forwardly in the document conveying direction, ribs 263 diagonally connecting the opposite corners of the openings are provided obliquely with respect to the document conveying direction. These ribs 263 protrude by about 2 mm from the upper surface of the vacuum chamber 26. The so constructed vacuum chamber 26 is attached to the lower surface of the document table 12 by a suitable support means (not shown) such that the upper surface of the vacuum chamber 26 will be nearly coplanar with the upper surface of the document table 12. The vacuum chamber 26 is connected to a suction blower 36 via a duct 34 connected to a hole (not shown) formed in the farthest-side wall thereof. The drive roller 28 is disposed through support walls 264*a* and 264*b* provided to protrude forward in the document conveying direction from the opposite side walls of the vacuum chamber 26. The drive roller 28 comprises a rotating shaft 281 having one end portion supported rotatably by a bearing 38 in a support wall 122 provided to protrude downwardly from the lower surface on the farthest side of the document table 12, and four rollers 282 disposed on the rotating shaft 281 in correspondence with the four openings 261 in the document conveying direction. To the other end portion of the rotating shaft 281 of the so constructed drive roller 28, a roller drive gear 39 is loosely fitted, and an electromagnetic clutch 35 (CLT1) is disposed for drivingly connecting the roller drive gear 39 to the rotating shaft 281. Thus, when the electromagnetic clutch (CLT1) is deenergized, the rotating shaft 281 and the roller drive gear 39 can rotate relative to each other. When the electromagnetic clutch (CLT1) is energized, the rotating shaft 281 and the roller drive gear 39 are drivingly connected. The electromagnetic clutch (CLT1) is adapted to be controlled by the control means 100 to be described later. As shown in FIG. 1, the roller drive gear 39 mounted on the rotating shaft 281 is drivingly connected to an electric motor 500 (M1) as a feed motor via power transmission mechanisms 502, 503 and 504 such as gear mechanisms or belt mechanisms. On the electric motor 500 (M1), there is mounted a rotational amount detecting means 501 (FG1), such as a rotary encoder or a frequency generator, which constitutes a document conveyance amount detecting means. This rotational amount detecting means 501 (FG1) sends a pulse signal, a detection signal, to the control means 100 to be described later. The driven roller 30 comprises a shaft 301 supported by support walls 265 and 266 provided to protrude rearward in the document conveying direction from the opposite side walls of the vacuum chamber 26, and four rollers 302 disposed rotatably on the rotating shaft 301 in correspondence with the four openings 262 in the document conveying direction. The four feed belts 32 have a plurality of holes 321, and are wound round the respective rollers 282 and 302 of the drive roller 28 and the driven roller 30. The so constructed feed belts 32 are disposed such that their upper surfaces are located slightly above the upper surface of the document table 12. The so wound feed belts 32 are deformed in wavy form by the ribs 263 at the openings 261 formed in the vacuum chamber 26. Thus, air easily enters between the lowermost, first document suction-attached to the feed belts 32 and the second or later document as will be described later.

Figure 3:
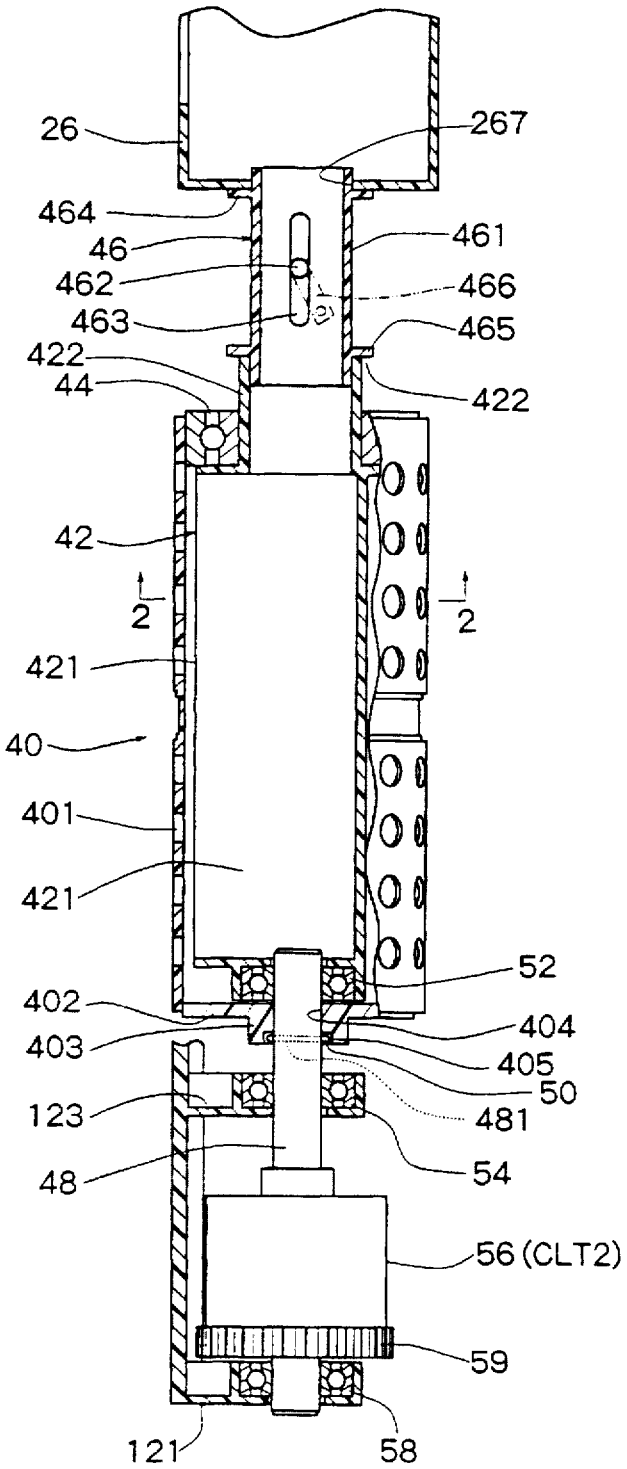
FIG. 3 is a sectional view taken on line A—A of the vacuum separating/feeding means shown in FIG. 2.
Figure 4:
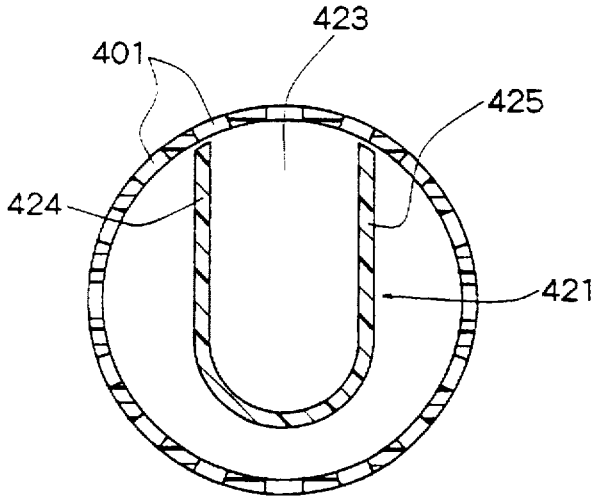
FIG. 4 is a sectional view taken on line B—B of the vacuum separating/feeding means shown in FIG. 3.

Below the document table 12, a feed drum 40 is disposed in correspondence with the second opening 16 as shown in FIG. 2. The feed drum 40, as shown in FIGS. 3 and 4, is formed of a plastic material, and has a plurality of holes 401 at the periphery. One end of the feed drum 40 is open, and a duct 42 for connection to the vacuum chamber 26 is inserted into this open end. The duct 42 comprises a suction portion 421 and a connecting portion 422. The suction portion 421 has an opening 423 as shown in FIG. 4. The opening 423 is formed such that only the upper side of the suction portion 421 is open in the axial direction. The upper end sides of side walls 424, 425 of the duct 42 forming the opening 423 are as close to the inner peripheral surface of the feed drum 40 as possible. Thus, each of the plurality of holes 401 formed in the feed drum 40 opposes the opening 423 of the duct 42 and communicates with the duct 42, only when these holes are positioned upwardly. A bearing 44 is disposed between one end portion on the suction portion 421 side of the connecting portion 422 constituting the duct 42 and one end portion of the feed drum 40, so that the feed drum 40 is rotatably supported with respect to the duct 42. Between the duct 42 and the vacuum chamber 26, there is disposed an on-off valve 46 constituting an opening-closing means for establishing or cutting off communication between the vacuum chamber 26 and the feed drum 40. The on-off valve 46 comprises a valve housing 461, and a butterfly valve 463 mounted on a valve shaft 462 mounted on the valve housing 461. One end portion of the valve housing 461 is inserted into and connected to the vacuum chamber 26 through a connecting hole 267 formed in a side wall of the vacuum chamber 26. On the outer periphery of the one end portion of the valve housing 461, a flange 464 is provided to restrict insertion into the vacuum chamber 26. The flange 464 is fixed to the side wall of the vacuum chamber 26 by a securing means such as a machine screw. The other end portion of the valve housing 461 is inserted into and connected to the other end portion of the connection portion 422 constituting the duct 42. On the outer periphery of the other end portion of the valve housing 461, a flange 465 is provided to restrict insertion into the duct 42. The so constructed on-off valve 46 has a lever 466 mounted on its valve shaft 462. The lever 466 is connected to a plunger of a solenoid 468 (SOL1) (see FIG. 2) via a link mechanism. The butterfly valve 463 actuated by the solenoid 468 (SOL1) is in a closed state when the solenoid 468 (SOL1) is deenergized, but is open when the solenoid 468 (SOL1) is energized. The solenoid 468 (SOL1) is deenergized when the second document detecting sensor 23 (SW2) does not detect the document, and is energized by the control means 100 (to be described later) when the second document detecting sensor 23 (SW2) detects the document.

An end wall 402 is provided at the other end of the feed drum 40. A boss 403 is formed at the center of the end wall 402, and a shaft fitting hole 404 and a pin fitting groove 405 are provided in the boss 403. An end portion of a rotating shaft 48 is fitted into the shaft fitting hole 404 provided in the boss 403 of the end wall 402 constituting the feed drum 40. The rotating shaft 48 has a pin insertion hole 481 passing diametrically through the shaft center. A pin 50 fitted into the pin insertion hole 481 is fitted in the pin fitting groove 405 formed in the boss 403, whereby a driving force of the rotating shaft 48 is transmitted to the feed drum 40. A bearing 52 is disposed between an end portion of the rotating shaft 48 inserted into the feed drum 40 and an end portion of the suction portion 421 constituting the duct 42, so that the other end portion of the duct 42 is supported rotatably relative to the one end portion of the rotating shaft 48. The rotating shaft 48 has an intermediate portion supported rotatably via a bearing 54 on a support wall 123 provided to protrude downwardly from the lower surface of the document table 12. The other end of the rotating shaft 48 is rotatably supported by a bearing 58 on the support wall 121. On the other end portion of the rotating shaft 48, a feed drum drive gear 59 is loosely fitted, and an electromagnetic clutch 56 (CLT2) is disposed for drivingly connecting the feed drum drive gear 59 to the rotating shaft 48. Thus, when the electromagnetic clutch 56 (CLT2) is deenergized, the rotating shaft 48 and the feed drum drive gear 59 can make relative rotations, whereas when the electromagnetic clutch 56 (CLT2) is energized, the rotating shaft 48 and the feed drum drive gear 59 are drivingly connected. The feed drum drive gear 59 is drivingly connected to the roller drive gear 39 via an intermediate gear 61 as shown in FIG. 2. The numbers of the teeth of the intermediate gear 61 and the feed drum drive gear 59 as driving means for transmitting power from the roller drive gear 39 to a drive shaft 60 of the feed drum 40 are set such that the moving speed of the feed belts 32 actuated by the drive roller 28 of the vacuum separating/feeding means 24 is nearly equal to the peripheral speed of the feed drum 40. The electromagnetic clutch 56 (CLT2) is deenergized when the second document detecting sensor 23 (SW2) does not detect the document, and is energized by the control means 100 (to be described later) when the second document detecting sensor 23 (SW2) detects the document.

The vacuum separating/feeding means 24 has a separating air jetting means 62, a so-called air knife, disposed above a front end part of the document table 12 in the document conveying direction. This separating air jetting means 62 comprises a pneumatic chamber 621, a nozzle 622 for jetting air in the pneumatic chamber 621 toward a front end part of the document set on the document table 12, a blower 623 for supplying air to the pneumatic chamber 621, and a servomotor 624 for driving the blower 623. In the illustrated embodiment, the servomotor 624 has a rotational speed adjusted by the control means 100 (to be described later) on the basis of a detection signal from a document load detecting means, namely, the load of the set documents placed on the document table 12. That is, when the load of the set documents is heavy, the rotational speed of the servomotor 624 is high. For a light load of the set documents, the rotational speed of the servomotor 624 is low. Thus, the blower 623 driven by the servomotor 624 has a rotational speed adjusted in response to the load of the documents, i.e., the weight of the documents set on the document table 12. Accordingly, the amount of air jetted from the nozzle 622 is adjusted in response to the weight of the documents on the document table 12. When air is jetted from the nozzle 622 of the so constructed separating air jetting means 62, air is injected between the documents laid on the document table 12, performing a document separating action.

A set document stopper 63 is disposed above a front end part of the vacuum separating/feeding means 24 in the document conveying direction. A discharged document stopper 64 is disposed upstream from the set document stopper 63 in the document conveying direction. Three each of the set document stoppers 63 and the discharged document stoppers 64 are disposed with spacing in the width direction (the direction perpendicular to the sheet face in FIGS. 1, 5 and 6; the right-and-left direction in FIG. 7) of the document table 12 according to the illustrated embodiment. These set document stoppers 63 and discharged document stoppers 64 are supported by support means 66 and 67, mounted on an upper wall 65 of a plastic material mounted at the upper ends of the opposite side plates 11, so as to be movable in the up-and-down direction.

The set document stopper 63 is composed of a metal plate such as of stainless steel, and has an elongated hole 631 in an intermediate part thereof. An upper end part of the set document stopper 63 is bent to form an acted-on portion 632. The support means 66 supporting the set document stopper 63 comprises a mounting boss 661 integrally formed with the plastic upper wall 65 so as to protrude downwardly; and a support plate 663 comprising a metal plate mounted to the boss 661 by a machine screw 662. This support plate 663 has a hole 664 at a central part, and has at a lower end part guide portions 665, 665 bent nearly at right angles on both sides. The set document stopper 63 is supported by the so constructed support plate 663 so as to be movable in the up-and-down direction. That is, the set document stopper 63 is disposed between the guide portions 665, 665 of the support plate 663, a bolt 666 is inserted through the hole 664 of the support plate 663 and the elongated hole 631 of the set document stopper 63, and a nut 667 is screwed over the bolt 666. The set document stopper 63 so supported on the support means 66 is movable between a stop position (see FIG. 5) where the lower end of the set document stopper 63 contacts the upper surface of the document table 12, and a document separation position (retreat position) (FIGS. 1 and 6) where the lower end of the set document stopper 63 lies above the upper surface of the document table 12 with a predetermined spacing. When the set document stopper 63 is situated at the document separation position, the spacing between the upper surface of the document table 12 and the lower end of the set document stopper 63 is desirably set at 2.0 to 3.0 mm. When air is jetted by the separating air jetting means 62 to the front ends of the documents plated on the document table 12, air is blown between the documents. At the front end parts of the documents, the second and later documents are floated and separated from the lowermost document. At the central parts to the rear ends of the documents, by contrast, air is not blown, so that the respective documents are kept in contact. Thus, when the lowermost, first document is suction-attached to and fed by the feed belts 32 of the vacuum separating/feeding means 24, the second and later documents are also dragged and fed because of a frictional force generated by that contact. When the spacing between the upper surface of the document table 12 and the lower end of the set document stopper 63 is set at 2.0 to 3.0 mm on this occasion, the lowermost document suction-attached to the feed belts 32 is smoothly fed without interference from the set document stopper 63. Whereas the second and later documents have front end portions floated by the separating air, and contact the set document stopper 63, whereby their movement is restrained, thus preventing their dragged overlap feeding. The set document stopper 63 thus has the function to prevent dragged overlap feed of documents.

Figure 8:
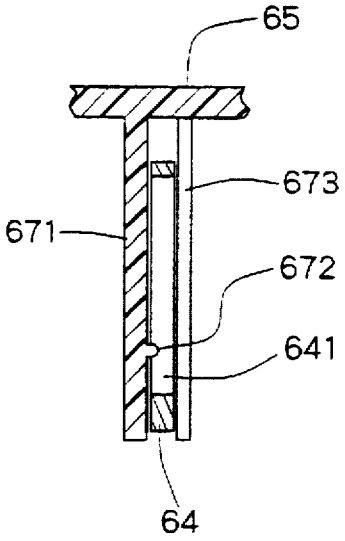
FIG. 8 is a sectional view taken on line C—C of FIG. 7.

Also, the discharged document stopper 64 is composed of a plastic material in the illustrated embodiment, and has an elongated hole 641 in its intermediate part, and acted-on protrusions 642, 642 on both sides of its upper end part. A support means 67 for supporting the discharged document stopper 64, on the other hand, has a support member 671 formed integrally with the upper wall 65 of a plastic material so as to protrude downwardly, and guide members 673, 673, as shown in FIG. 8. The support member 671 has a guide protrusion 672 at the center of its lower end part. The guide members 673, 673 are disposed with a predetermined spacing (a slightly larger spacing than the thickness of the discharged document stopper 64) from the support member 671 and at positions opposing both side parts of the support member 671. The discharged document stopper 64 is inserted between the support member 671 and the guide members 673, 673 of the so constructed support means 67. Then, the guide protrusion 672 provided on the support member 671 is fitted into the elongated hole 641 formed in the discharged document stopper 64, whereby the discharged document stopper 64 is supported by the support means 67 so as to be movable in the up-and-down direction. The discharged document stopper 64 so supported by the support means 67 is adapted to be movable between the restraint position (see FIGS. 1 and 6) where the discharged document stopper 64 contacts the set documents placed on the document table 12 and the retreat position (see FIG. 5) where it retreats upward of the document table 12. When the set documents are fed and decreased on the document table 12 with the discharged document stopper 64 being at the restraint position where it contacts the set documents placed on the document table 12, the discharged document stopper 64 goes down by its own weight following the decrease of the documents under the action of the elongated hole 641. Thus, the discharged document stopper 64 also functions as a means of preventing the floating of the set documents. The three discharged document stoppers 64 are supported independently by the three support means 67, so that if the set documents float, the respective discharged document stoppers 64 always contact the floating documents. Thus, the documents being discharged can be prevented from sinking below the discharged document stopper 64.

Figure 9:
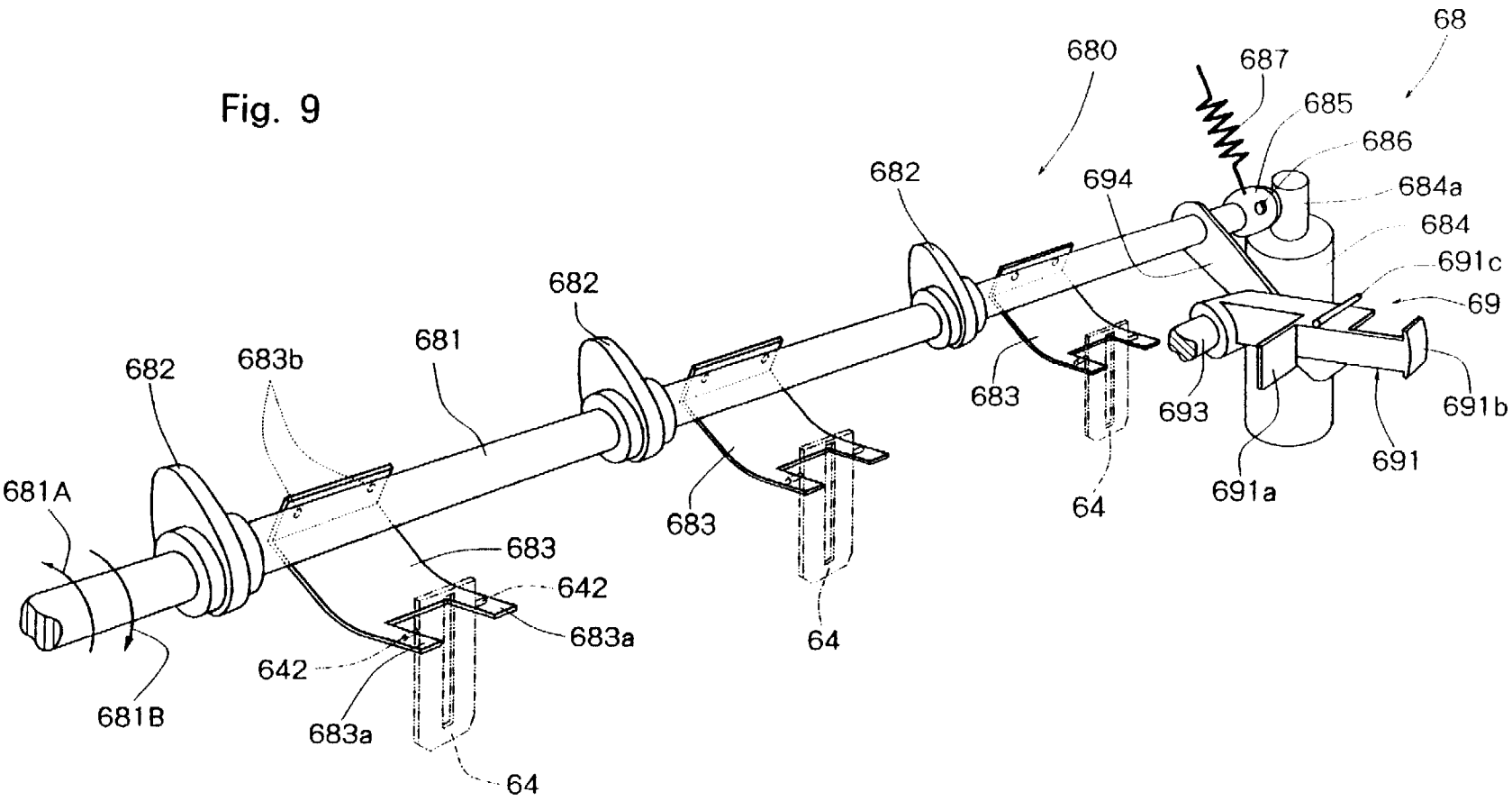
FIG. 9 is an essential part perspective view of a stopper moving means and a document load detecting means mounted on the automatic document conveying device shown in FIG. 1.

Next, a stopper moving means 68 for bringing the set document stopper 63 and the discharged document stopper 64 to the predetermined positions will be described with reference to FIG. 9 as well. The stopper moving means 68 has a moving mechanism 680, and a single solenoid 684 as a means of driving the moving mechanism 680. The moving mechanism 680 constituting the stopper moving means 68 is disposed downstream from the set document stopper 63 in the document conveying direction, and has a moving shaft 681 rotatably supported by the opposite side plates 11. On the moving shaft 681, three moving cams 682 are mounted at positions corresponding to the set document stoppers 63, and three moving levers 683 are mounted at positions corresponding to the discharged document stoppers 64. The three moving cams 682 are disposed to contact the lower surfaces of the acted-on portions 632 of the three set document stoppers 63. The moving cams 682 are turned by the rotation of the moving shaft 681 to move the set document stoppers 63 to the stop position or the document separation position. The three moving levers 683 are constituted by a metal plate such as one of stainless steel. At one end of the moving lever 683, two moving pieces **683*a*, 683*a* are formed to protrude, while the other end of the moving lever 683 is attached to the moving shaft 681 by machine screws 683*b*, 683*b*. The two moving pieces 683*a*, 683*a* provided at the moving lever 683 define a distance between themselves, the distance being slightly greater than the width of the discharged document stopper 64. The discharged document stopper 64 is positioned between the two moving pieces, which are engaged with the acted-on protrusions 642, 642 provided on the discharged document stopper 64. Thus, the moving lever 683 is turned by the rotation of the moving shaft 681 to move the discharged document stopper 64 to the restraint position and the retreat position. The single solenoid 684 as a means of driving the stopper moving means 68 has its plunger 684*a* connected by a pin 686 to a lever 685 mounted at a farthest-side end part of the moving shaft 681, thereby to rotate the moving shaft 681 through a predetermined angle. To the lever 685 mounted on the moving shaft 681, there is fastened the other end of a return spring 687 whose one end is fastened to a fixing part of the side plate. By the action of this return spring 687, the moving shaft 681 is urged to turn in the direction of an arrow 681A in FIG. 9. Thus, the moving shaft 681, the moving cam 682 mounted on the moving shaft 681, and the moving lever 683 are positioned in the state of FIG. 5 when the solenoid 684 is deenergized. That is, the base circle of the moving cam 682 contacts the lower surface of the acted-on portion 632 of the set document stopper 63, so that the set document stopper 63 is put to the stop position, and the moving lever 683 turns upward to bring the discharged document stopper 64 to the retreat position. When the solenoid 684 is energized from the state of FIG. 5, the moving shaft 681 is turned in the direction of an arrow 681B in FIG. 9 via the plunger 684***a* and the lever 685. Thus, the moving cam 682 and the moving lever 683 mounted on the moving shaft 681 are positioned in the state of FIGS. 1 and 6. That is, the set document stopper 63 is brought to the document separation position by the cam portion of the moving cam 682, and the moving lever 683 is turned downward to bring the discharged document stopper 64 to the restraint position. The stopper moving means 68 so moving the set document stopper and the discharged document stopper is constructed of the single solenoid 684 and the moving mechanism 680. Thus, the stopper moving means 68 can be produced for a low cost. Moreover, the moving mechanism 680 is constructed from a combination of the moving shaft 681, the moving cam 682 and the moving lever 683. Its structure is so compact that it can be easily disposed above the document table 12.

Figure 5:
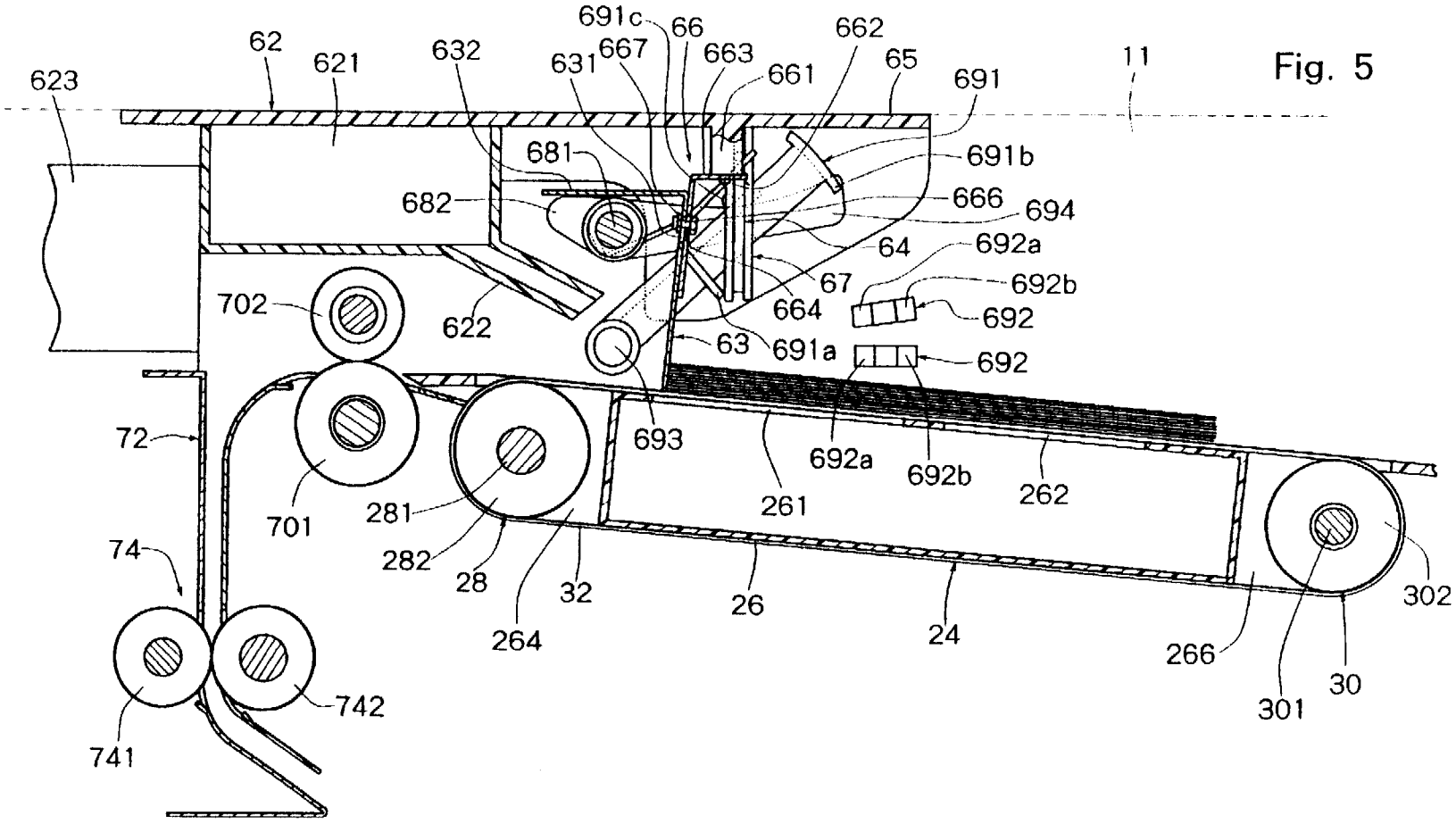
FIG. 5 is an essential part enlarged sectional view showing a state in which documents are set in the automatic document conveying device shown in FIG. 1.
Figure 6:
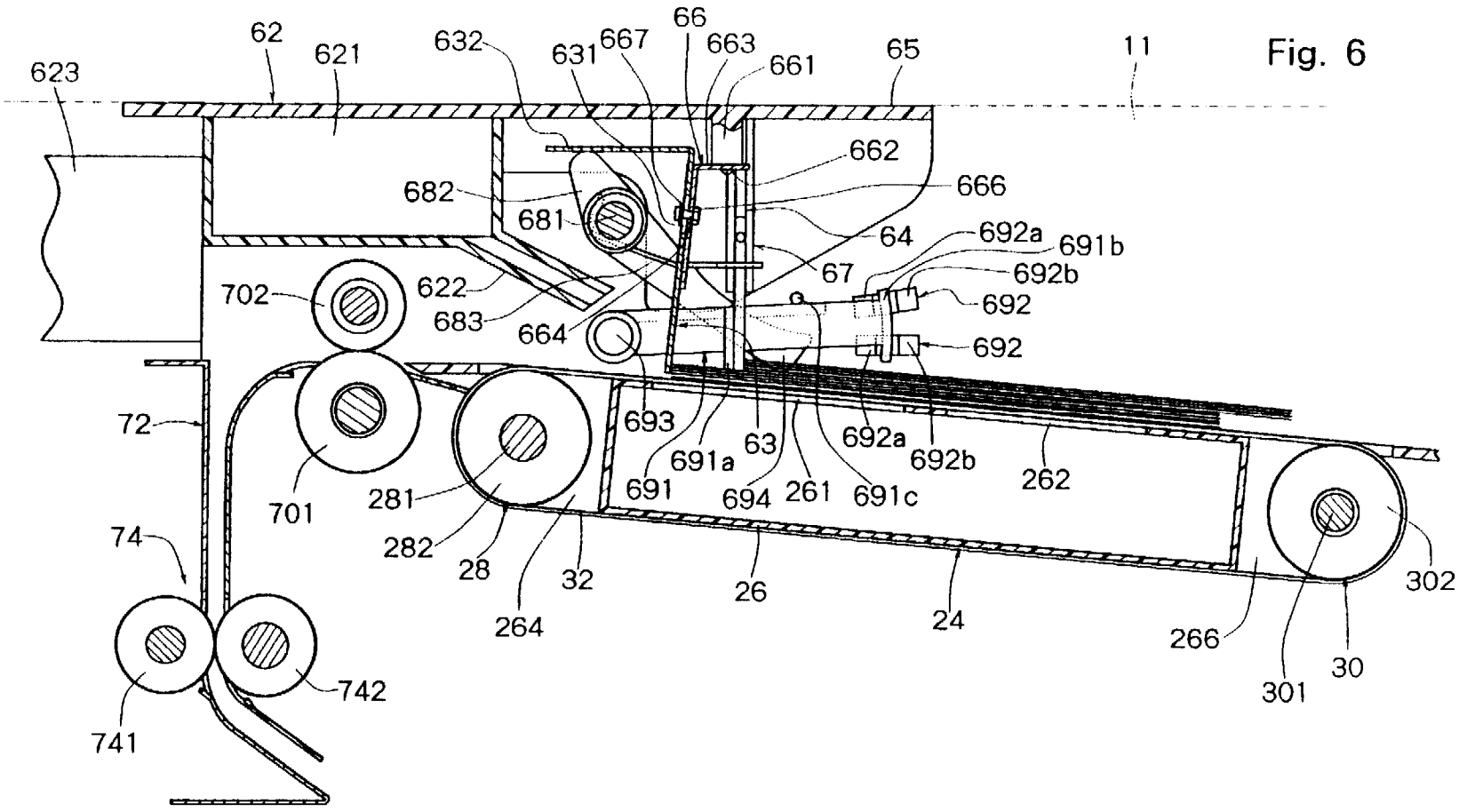
FIG. 6 is an essential part enlarged sectional view showing a state in which documents are conveyed in the automatic document conveying device shown in FIG. 1.
Figure 7:
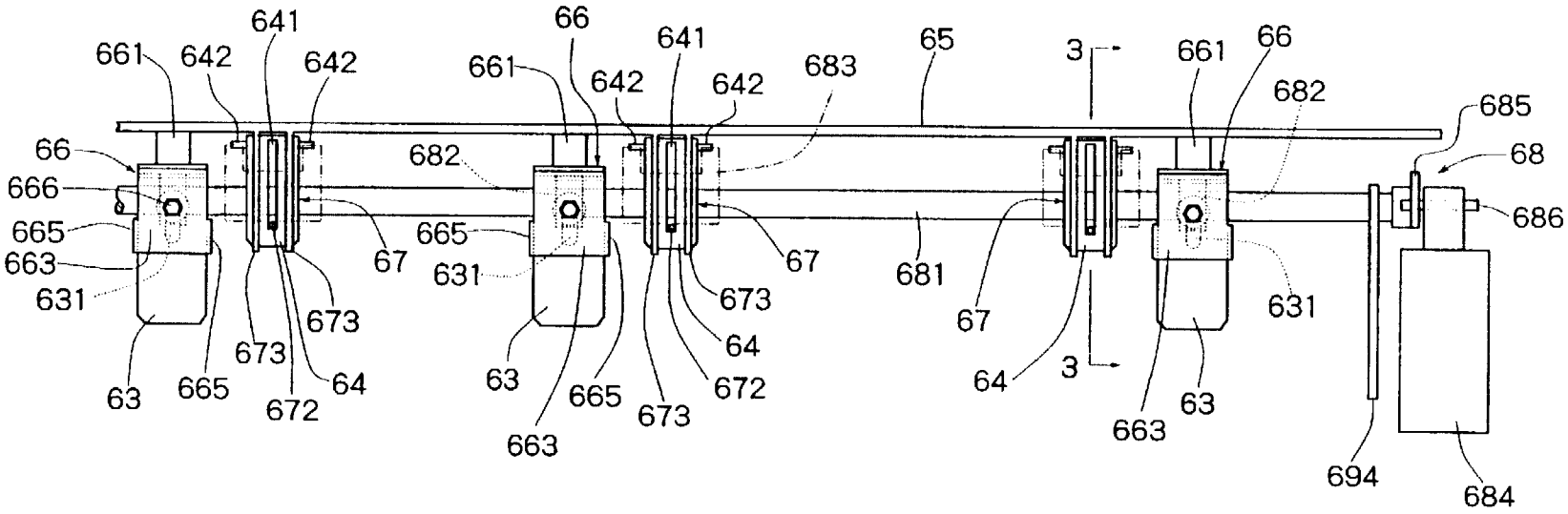
FIG. 7 is an essential part front view showing the relationship among a set document stopper, a discharged document stopper, and a stopper moving means mounted on the automatic document conveying device shown in FIG. 1.

The illustrated automatic document conveying device 4 has a document load detecting means 69 for detecting the load of the set documents placed on the document table 12. The document load detecting means 69 has a detector member 691 and two detectors 692, 692. The detector member 691 is composed of a plastic material, and has at an intermediate part a detection portion 691*a* which protrudes to the nearest side (toward the operator) and which is placed on the set documents on the document table 12. At one end of the detector member 691, there is provided a shield portion 691*b* which protrudes to the farthest side (away from the operator) and blocks light from the detector 692. At an intermediate part of the detector member 691, there is provided an acted-on protrusion 691*c* which protrudes to the farthest side and which the moving lever to be described later engages. The so constructed detector member 691 has the other end part thereof supported turnably on a short shaft 693 fixed to the side plate on the farthest side. In the illustrated embodiment, the detection portion 691*a* of the detector member 691 is positioned between the set document stopper 63 and the discharged document stopper 64 when placed on the set documents. Thus, the document returned onto the set documents after the set document has been fed does not contact the detection portion 691*a* of the detector member 691. The two detectors 692, 692 each have a light emitting element 692*a* and a light receiving element 692*b* as illustrated in FIGS. 5 and 6. These detectors 692, 692 are disposed, one above the other, and are attached to the farthest-side side plate. The two detectors 692, 692, and the shield portion 691*b* of the detector member 691 that moves between both elements can detect the altitudinal position of the detection portion 691*a*, i.e., the load of the set documents, on a scale of four states. The four states include the first state in which the load of the set documents is heavy and the shield portion 691*b* is located above the two detectors 692, 692; the second state in which the shield portion 691*b* blocks only the upper detector 692; the third state in which the shield portion 691*b* blocks the two detectors 692, 692; and the fourth state in which the shield portion 691*b* blocks only the lower detector 692. The stopper moving means 68 also has a moving lever 694 which engages the acted-on protrusion 691*c* of the detector member 691 constituting the document load detecting means 69 to move the detection portion 691*a* of the detector member 691 to the detection position and the retreat position. The moving lever 694 is mounted on the moving shaft 681 of the stopper moving means 68, and has its front end part engaging the acted-on protrusion 691*c* of the detector member 691. That is, when the solenoid 684 is deenergized, the moving lever 694 turns the detector member 691 upward to bring it to the retreat position as shown in FIG. 5. When the electromagnetic solenoid 684 is energized from the state of FIG. 5, the moving lever 694 turns downward, whereupon the detector member 691 turns downward by its own weight and comes to the detection position where the detection portion 691*a* contacts the set documents.

With reference to FIG. 1, a feed roller pair 70 is disposed downstream from the document table 20 in the document conveying direction. The feed roller pair 70 consists of a drive roller 701 and a driven roller 702. The drive roller 701 is drivingly connected to the electric motor 500 (M1) via power transmission mechanisms 502 and 503 so as to be rotationally driven in the direction of the arrow. Downstream from the feed roller pair 70, a document sending-in path 72 is disposed which guides the document fed by the feed roller pair 70 onto the transparent panel 8. On the document sending-in path 72, a resist roller pair 74 is disposed. The resist roller pair 74 consists of a drive roller 741 and a driven roller 742, and the drive roller 741 is drivingly connected to the electric motor 500 (M1) via the power transmission mechanism 502 and an electromagnetic clutch 75 (CLT3). On the document sending-in path 72 and upstream from the resist roller pair 74, there is disposed a reflector type sent-in document detecting sensor 720 (SW4) composed of a light emitting element and a light receiving element. The reflector type sent-in document detecting sensor 720 (SW4) detects the document passing through the document sending-in path 72, and sends a detection signal to the control means 100 to be described later.

A conveying belt mechanism 76 is disposed above the transparent panel 8. The conveying belt mechanism 76 constituting a document conveying means includes a drive roller 761 and a driven roller 762 disposed with spacing in the conveying direction of the transparent panel 8, an endless belt 763 wound between the drive roller 761 and the driven roller 762, and rollers 764*a*, 764*b*, 764*c*, 764*d*, 764*e* for rolling which are disposed between the drive roller 761 and the driven roller 762. The lower traveling portion of the endless belt 763 extends along the transparent panel 8 of the electrostatic copying machine 2, so that a document conveying path 78 is defined between the lower traveling portion and the transparent panel. The so constructed conveying belt mechanism 76 has the drive roller 761 as a delivery motor drivingly connected to an electric motor 510 (M2) via a power transmission mechanism 512. On the electric motor 510 (M2), there is mounted a rotational amount detecting means 511 (FG2), such as a rotary encoder or a frequency generator, which constitutes a document conveyance amount detecting means. Its detection signals, pulse signals, are sent to the control means 100 to be described later.

On the right side of the document conveying path 78 in FIG. 1, there is provided a document sending-out path 80 constituting a document discharge means. Along the document sending-out path 80, delivery roller pairs 82 and 84 and a discharge roller pair 86 are disposed. The delivery roller pairs 82 and 84 comprise drive rollers 821, 841 and driven rollers 822, 842, and the discharge roller pair 86 also comprises a drive roller 861 and a driven roller 862. These drive rollers 821, 841 and 861 are drivingly connected to an electric motor 520 (M3) as a discharge motor via power transmission mechanisms 522, 523 and 524 so as to be rotationally driven in the directions of the arrows. On the electric motor 520 (M3), there is mounted a rotational amount detecting means 521 (FG3), such as a rotary encoder or a frequency generator, which constitutes a document conveyance amount detecting means. Its detection signals, pulse signals, are sent to the control means 100 to be described later. Upstream from the discharge roller pair 86 on the document sending-out path 80, a reflector type discharged document detecting sensor 800 (SW5) composed of a light emitting element and a light receiving element is disposed. The discharged document detecting sensor 800 (SW5) detects the document passing through the document sending-out path 80, and sends a detection signal to the control means 100 to be described later. Below the discharge roller pair 86, a push-out plate 88 is disposed which is movable by a predetermined amount in the right-and-left direction in FIG. 1. This push-out plate 88 supports a rear end part of the document that has been discharged by the discharge roller pair 86 and stopped by the discharged document stopper 66. The push-out plate 88 also pushes the discharged document leftward in FIG. 1 to move it to the set document stopper 64. Thus, the amount of movement of the push-out plate 88 is set at the distance between the set document stopper 64 and the discharged document stopper 66. The discharge roller pair 86 and the push-out plate 88 constitute a discharge unit, which is movable in the right-and-left direction in FIG. 1 depending on the size of the document placed on the document table 20. A moving mechanism for the discharge unit constituted by the discharge roller pair 86 and the push-out plate 88, and a moving mechanism for the push-out plate 88 can follow the technology disclosed, for example, in Japanese Laid-Open Patent Publication No. 95077/91. The moving mechanism for the discharge unit and the moving mechanism for the push-out plate 88 have no direct relation to the present invention, and a detailed explanation for them is omitted herein.

Figure 10:
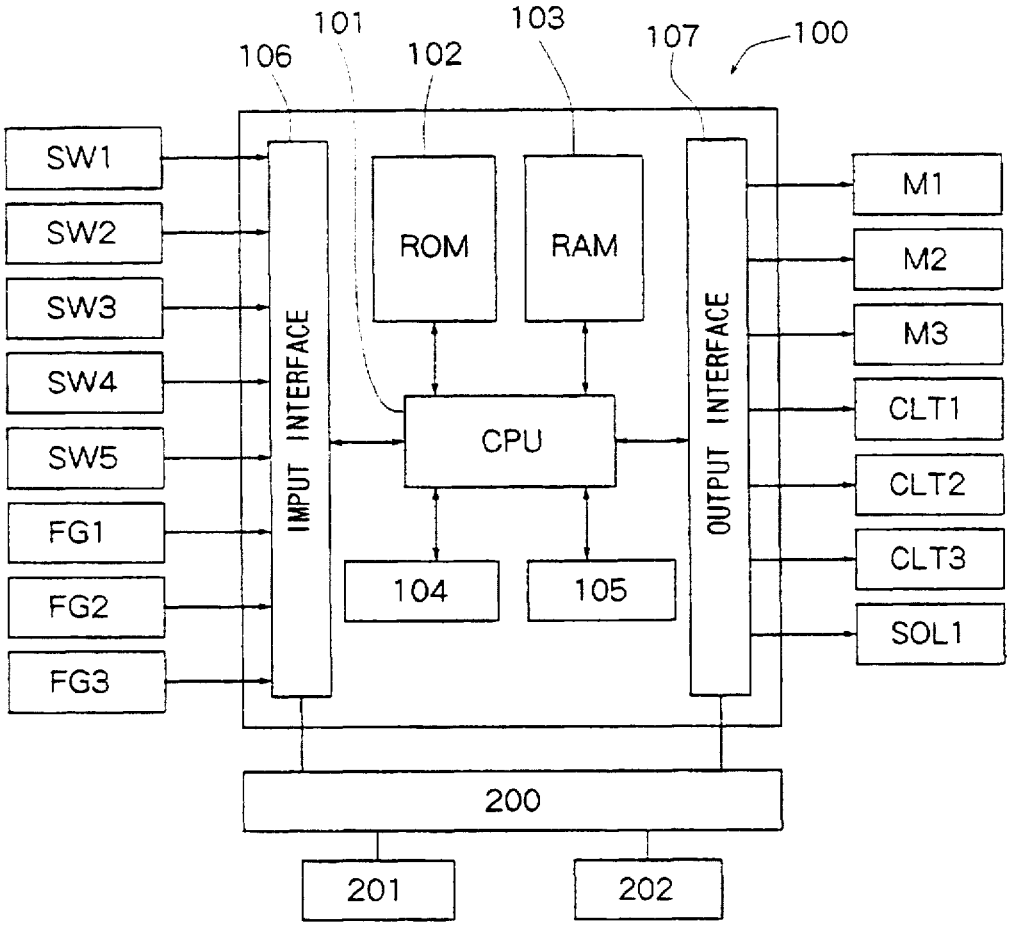
FIG. 10 is a block diagram of a control means mounted on the automatic document conveying device shown in FIG. 1.

Next, the control means 100 will be described with reference to FIG. 10. The control means 100 is constituted by a microcomputer, and has a central processing unit (CPU) 101 performing operations according to a control program, a read-only memory (ROM) 102 storing the control program, a random access memory (RAM) 103 storing the results of operations and being capable of reading and writing, a timer 104, a counter 105, an input interface 106, and an output interface 107. The input interface 106 of the so constituted control means 100 receives detection signals from the first document detecting sensor 21 (SW1), the second document detecting sensor 23 (SW2), the third document detecting sensor 27 (SW3), the sent-in document detecting sensor 720 (SW4), the discharged document detecting sensor 800 (SW5), the rotational amount detecting means 501 (FG1), 511 (FG2), 521 (FG3), and the detector 692 of the document load detecting means 69. The output interface 107 puts out control signals to the electric motors 500 (M1), 510 (M2), 520 (M3), the electromagnetic clutches 35 (CLT1), 56 (CLT2), 75 (CLT3), the solenoid 468 (SOL1), the servomotor 624, and the solenoid 684. The control means 100 is connected to a control means 200 of the electrostatic copying machine 2, so that control signals are exchanged between both means. To the control means 200 of the electrostatic copying machine 2, an operating means 201 and a display means 202 are connected. As shown in FIG. 1, the operating means 201 is arranged on the top of a front portion of the electrostatic copying machine 2, and includes operating keys for copy actions, such as a copy start key, a copy number designation key, a double-sided copy designation key, and a copy action stop key. Through these keys, the operating means 201 enters copy information into the control means 200 of the electrostatic copying machine 2. The display means 202 is disposed, similar to the operating means 201, on the top of the front portion of the electrostatic copying machine 2 and adjacent to the operating means 201 to display copy information, trouble information, and so forth.

The automatic document conveying device according to the illustrated embodiment is constituted as described above. Its actions will follow.

First, an explanation will be offered for the use of a document of a small width, such as the "A4" or "B5" size under the Japanese Industrial Standards (JIS). In setting documents on the document table 12, the electromagnetic solenoid 684 of the stopper moving means 68 is deenergized. Thus, the set document stopper 63 and the discharged document stopper 64 are positioned in the state of FIG. 5 in which the set document stopper 63 is brought to the stop position, and the discharged document stopper 64 is brought to the retreat position. The detector member 691 of the document load detecting means 69 is also put to the retreat position. Documents are placed on the document table 12 while being contacted with the set document stopper 63 whose front end is at the stop position. The width regulating member 20 is moved upward in FIG. 2, so that the widthwise position of the documents is regulated by the inner surface of the side plate 22 and the inner surface of the width regulating member 20. When documents of a small width are set on the document table 12 as described above, the nearest-side (the side nearest to the operator) edge of the document, i.e., the lower side edge of the document in FIG. 2, does not reach the second opening 16. When the documents are set on the document table 12 in this fashion, the first document detecting sensor 21 (SW1) detects that the documents have been set on the document table 12. Its detection signal is sent to the control means 100. When a copy start switch (not shown) is depressed in this state, the solenoid 684 of the stopper moving means 68 is energized. As a result, the set document stopper 63 and the discharged document stopper 64 are positioned in the state of FIGS. 1 and 6 in which the set document stopper 63 is brought to the document separation position, and the discharged document stopper 64 is brought to the restraint position. The detector member 691 of the document load detecting means 69 is also put to the detection position. The push-out plate 88 is moved from the position indicated by the solid line to the position indicated by the two-dot chain line by a moving mechanism (not shown). Simultaneously, a copy action is started, and the suction blower 36 is driven to suck air contained in the vacuum chamber 26. Thus, of the documents placed on the document table 12, the lowermost, first document is suction-attached to the feed belt 32 of the vacuum separating/feeding means 24. On this occasion, the electric motor 624 of the separating air jetting means 62 is driven to actuate the blower 623, so that air is jetted through the nozzle 622 toward the front ends of the documents placed on the document table 12. Thus, air is injected between the documents placed on the document table 12, whereby the respective documents are separated. The second or later documents have their front end parts floated upward of the lower end of the set document stopper 63. Hence, their movement toward the downstream side in the document conveying direction is restrained, and their dragged overlap feed is prevented. During this period, the feed belt 32 is deformed in wavy form by the ribs 263 in the openings 261 formed in the vacuum chamber 26. Thus, air easily enters between the lowermost, first document and the second or later document placed on the document table 12, ensuring separation of the lowermost document. When a copy start signal is sent to the control means 100, the control means 100 turns the electric motor 500 (M1) on, and energizes the electromagnetic clutch 35 (CLT1), to rotationally drive the drive roller 28 in the direction of the arrow. When the drive roller 28 is rotated, the feed belt 32 is moved in the direction of the arrow, whereupon the lowermost, first document suction-attached to the feed belt 32 is fed to the downstream side in the conveying direction. When the lowermost, first document is so fed downstream in the conveying direction, protrusions of the respective feed belts 32 by the ribs 263 provided obliquely with respect to the document conveying direction are formed in the entire widthwise direction, even if the second or later document is not floated by air. Thus, a rub between the lowermost, first document and the second or later document by the protrusions of the feed belts does not concentrate in a particular site, but disperses, thus diminishing a stain of the document. The ribs 263 formed in the openings 261 of the vacuum chamber 26 are provided obliquely with respect to the document conveying direction, so that the feed belts 32 contact the ribs 263 in the entire widthwise direction. Consequently, wear only of particular sites is prevented. When documents of a small width are used, the second document detecting sensor 23 (SW2) does not detect the documents. Since the solenoid 468 (SOL1) is deenergized, the on-off valve 46 is in a closed state, so that communication between the vacuum chamber 26 and the feed drum 40 is cut off. When the second document detecting sensor 23 (SW2) does not detect the documents, the electromagnetic clutch 56 (CLT2) is deenergized. Hence, the feed drum 40 is also stopped.

The document so fed by the vacuum separating/feeding means 24 is delivered to the document sending-in path 72 by the feed roller pair 70. When a predetermined period of time passes after the sent-in document detecting sensor 720 (SW4) detects the front end of the delivered document, this document is brought into contact with the nip site of the resist roller pair 74 inoperable because of deenergization of the electromagnetic clutch 75 (CLT3). At this time, the electric motor 500 (M1) is turned off to complete primary feeding. Then, the electric motor 500 (M1) is turned on again, and the electromagnetic clutch 75 (CLT3) is energized to actuate the resist roller pair 74. The document fed until the nip site is delivered to the document conveying path 78 extending along the transparent panel 8 of the electrostatic copying machine 2. Further, the electric motor 510 (M2) is driven, and the document is conveyed from left to right in FIG. 2 on the transparent panel 8 by the conveying belt mechanism 76 constituting the conveying means. The document is thereby positioned at a predetermined position, whereupon secondary feeding is completed. In this state, an exposure action is performed.

When an exposure action on the document positioned on the transparent panel 8 is finished in this manner, the electric motor 510 (M2) is driven again, and the electric motor 520 (M3) is driven. Thus, the conveying belt mechanism 76 is actuated to deliver the document on the transparent panel 8 toward the document sending-out path 80. The document delivered to the document sending-out path 80 is delivered toward the discharge roller pair 86 by the delivery roller pairs 82 and 84. Past the discharge roller pair 86, the document is conveyed onto the set document placed on the document table 12. At this time, the front end of the discharged document contacts the discharged document stopper 66, whereby this document is distinguished from the initially set document. A rear end part of the document discharged onto the document table 12 is supported on the push-out plate 88 positioned at the two-dot chain line in FIG. 1. In this manner, all of the set documents placed on the document table 12 are fed and returned onto the document table 12 after exposure action. In this case, the electromagnetic solenoid 684 of the stopper moving means 68 is deenergized, whereupon the set document stopper 63, the discharged document stopper 64 and the detector member 691 of the document load detecting means 69 are brought into the state of FIG. 5 in which the set document stopper 63 is brought to the stop position, the discharged document stopper 64 to the retreat position, and the detector member 691 of the document load detecting means 69 to the retreat position. The push-out plate 88, on the other hand, is moved by the moving mechanism (not shown) from the position indicated by the two-dot chain line to the position indicated by the solid line in FIG. 1. According to this movement of the push-out plate 88 to the position indicated by the solid line, the rear end parts of the documents discharged onto the document table 12 and supported on the push-out plate 88 are dropped onto the document table 12. If the documents discharged onto the document table 12 are to be copied again, the push-out plate 88 is moved by the moving mechanism (not shown) to the position indicated by the two-dot chain line in FIG. 1. As a result, the documents returned onto the document table 12 are pushed leftward in the drawing by the push-out plate 88, and their front ends are brought into contact with the set document stopper 63 for resetting.

Next, an explanation will be offered for the use of a document of a large width, such as the JIS "A3" or "B4" size. In setting documents on the document table 12, the electromagnetic solenoid 684 of the stopper moving means 68 is deenergized. The set document stopper 63, the discharged document stopper 64, and the detector member 691 of the document load detecting means 69 are positioned in the state of FIG. 5 in which the set document stopper 63 is brought to the stop position, the discharged document stopper 64 to the retreat position, and the detector member 691 of the document load detecting means 69 is also put to the retreat position. In this state, the width regulating member 20 is moved to the operator side relative to the second opening 16, namely, downward in FIG. 2. Then, documents to be copied are placed on the document table 12, and the width regulating member 20 is moved upward in FIG. 2, whereupon the widthwise position of the documents is regulated by the inner surface of the side plate 22 and the inner surface of the width regulating member 20. When documents of a large width are set on the document table 12 as described above, the documents are placed across the first opening 14 ad the second opening 16. When the documents are set on the document table 12 in this fashion, the first document detecting sensor 21 (SW1) and the second document detecting sensor 23 (SW2) detect that the documents have been set on the document table 12. This detection signal is sent to the control means 100. When a copy start switch (not shown) is depressed in this state, a copy start signal is sent to the control means 100 by the control means 200 of the electrostatic copying machine 2. Based on this copy start signal, the control means 100 actuates and controls the respective constituents of the automatic document conveying device. That is, the electromagnetic solenoid 684 of the stopper moving means 68 is energized. As a result, the set document stopper 63, the discharged document stopper 64, and the detector member 691 of the document load detecting means 69 are positioned in the state of FIG. 1 in which the set document stopper 63 is brought to the document separation position, the discharged document stopper 64 to the restraint position, and the detector member 691 of the document load detecting means 69 to the detection position. The push-out plate 88 is moved by the moving mechanism (not shown) from the position indicated by the solid line to the position indicated by the two-dot chain line. Simultaneously, a copy action is started, and the suction blower 36 is driven to suck air contained in the vacuum chamber 26. Furthermore, when the second document detecting sensor 23 (SW2) detects the documents, the solenoid 468 (SOL1) is energized, so that the on-off valve 46 is opened to establish communication between the vacuum chamber 26 and the feed drum 40. Thus, a front end part of the lowermost, first document of the documents placed on the document table 12 is suction-attached to the feed belts 32 of the vacuum separating/feeding means 24, and also to the feed drum 40. On this occasion, the servomotor 624 of the separating air jetting means 62 is driven to actuate the blower 623, so that air is jetted through the nozzle 622 toward the front ends of the documents placed on the document table 12. Thus, air is injected between the documents placed on the document table 12, whereby the respective documents are separated, and the lowermost, first document is separated. Moreover, when a copy start signal is sent to the control means 100, the control means 100 turns the electric motor 500 (M1) on, and energizes the electromagnetic clutch 35 (CLT1), to rotationally drive the drive roller 28 in the direction of the arrow. When the drive roller 28 is rotated, the feed belts 32 are moved in the direction of the arrow. In addition, when the second document detecting sensor 23 (SW2) detects the document, the feed drum 40 is rotated, since the electromagnetic clutch 56 (CLT2) is energized. Thus, the lowermost, first document suction-attached to the feed belts 32 and the feed drum 40 is fed to the downstream side in the conveying direction. When documents of a large width are placed on the document table 12, that is, when the second document detecting sensor 23 (SW2) detects the documents, the feed drum 40 disposed beside the vacuum separating/feeding means 24 is actuated. The vacuum separating/feeding means 24 and the feed drum 40 feed the lowermost, first document while sucking it in its entire widthwise direction. Hence, oblique feed of the document is prevented reliably. In the illustrated embodiment, when documents of a small width are placed on the document table 12, that is, when the second document detecting sensor 23 detects no documents, the solenoid 468 (SOL1) is deenergized, and the on-off valve 46 is closed. Thus, the degree of vacuum within the vacuum chamber 26 of the vacuum separating/feeding means 24 does not lower. Also, in the illustrated embodiment, when the second document detecting sensor 23 (SW2) detects no documents, the electromagnetic clutch 56 (CLT2) is deenergized, and the feed drum 40 stops. Since the feed drum 40 does not rotate without bearing documents thereon, safety can be secured.

The documents so set on the document table 12 are delivered onto the transparent panel 8 and exposed, and then returned onto the document table 12 by the document discharge means. At this time, there is no problem when the documents are present on the document table 12. If no documents are present on the document table 12, the following problem arises: If two documents are set on the document table 12, primary feeding and secondary feeding of the second document have already taken place, when the first document is discharged onto the document table 12 after exposure operation. Thus, the second document is absent on the document table 12, meaning no documents present on the document table 12. When the first document is discharged in the absence of documents on the document table 12, the front end of the document contacts the feed belts 32 of the vacuum separating/feeding means 24 whose operation has stopped. Since the feed belts 32 are made of a rubber material, the front end of the document is snagged, whereby a bend or jam of the document may occur. To avoid this trouble, the automatic document conveying device according to the illustrated embodiment is operated as shown in flow charts of FIGS. 11 and 12.

Figure 11:
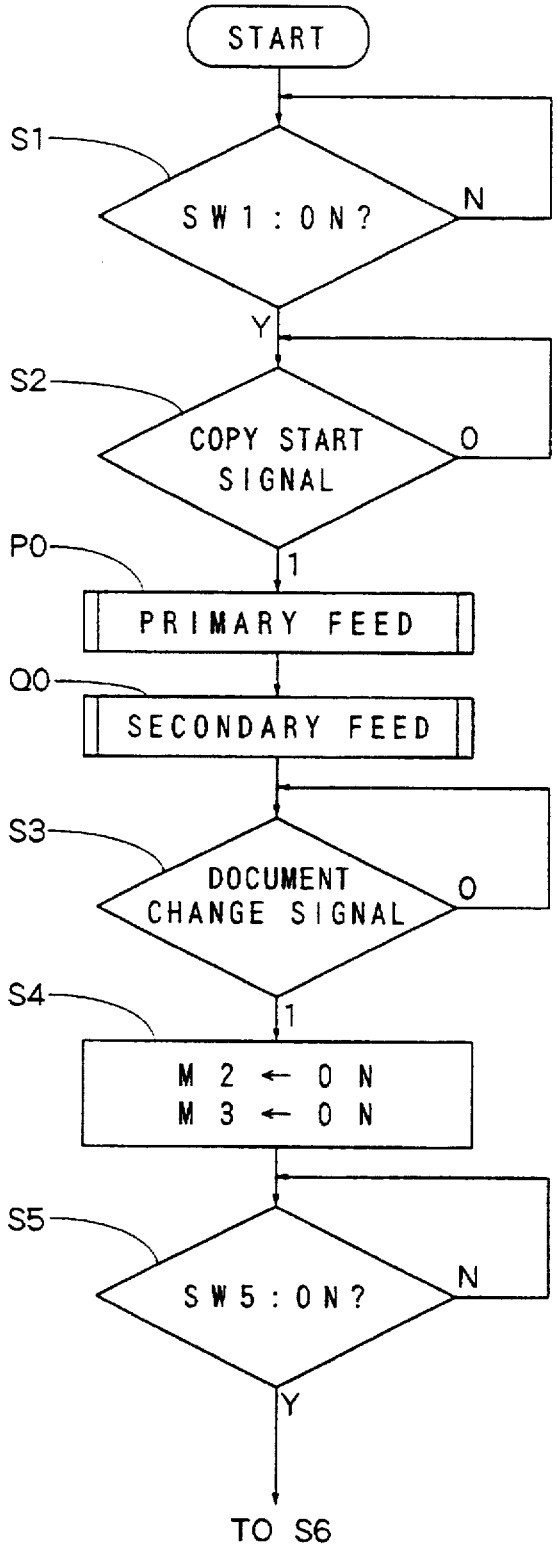
FIG. 11 is a partial flow chart showing the procedure for processing by the control means illustrated in FIG. 10.
Figure 12:
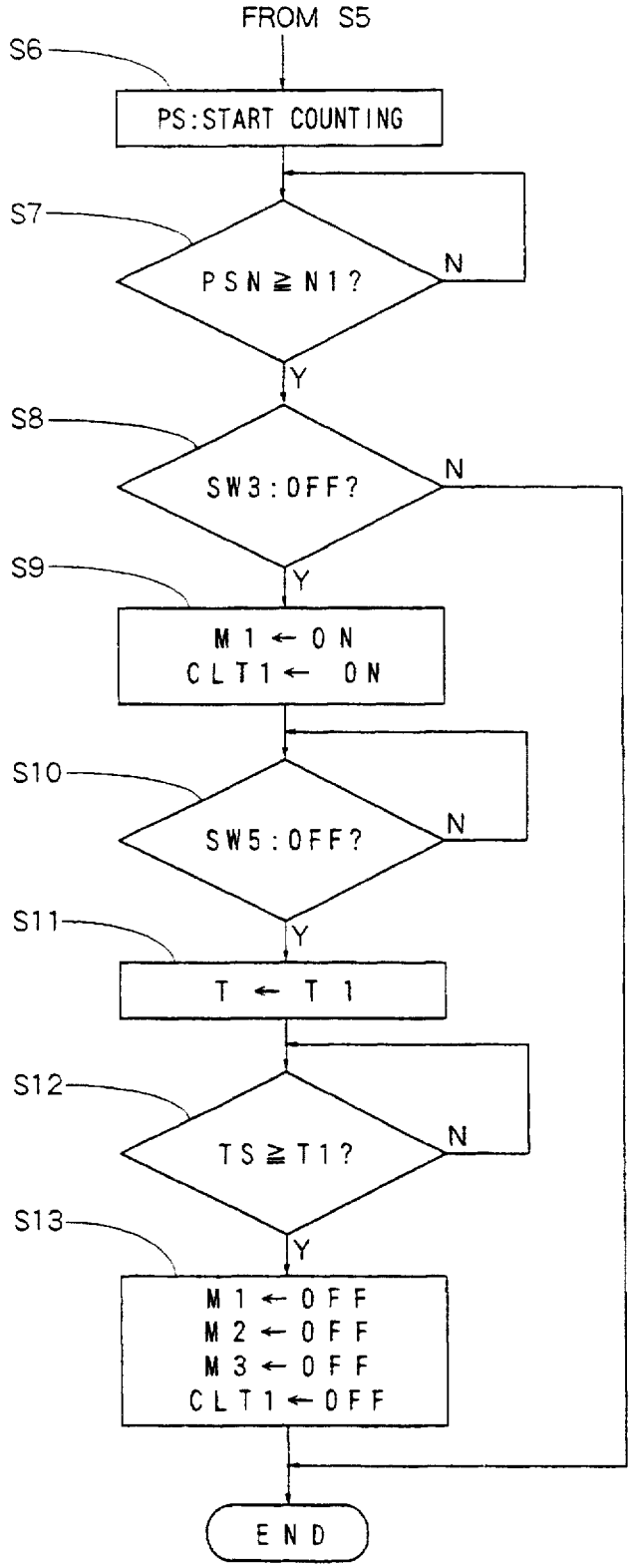
FIG. 12 is a partial flow chart showing the procedure for processing by the control means illustrated in FIG. 10.

Hereinafter, the operating procedure during discharge of the first document in the automatic document conveying device will be described with reference to the flow charts shown in FIGS. 11 and 12.

The control means 100 checks whether the first document detecting sensor 21 (SW1) is ON or not, namely, whether documents have been set on the document table 12 or not (step 1). When documents have been set on the document table 12, step S2 is effected to check whether a copy start signal has been sent by the control means 200 of the electrostatic copying machine 2. This copy start signal is sent by the control means 200 to the control means 100 when entered by the operator from the copy start key of the operating means 201. Upon receipt of the copy start signal at step S2, step P0 is effected to execute a subroutine for a primary feeding action for conveying the lowermost, first document, set on the document table 12, to the resist roller pair 74. Moreover, step Q0 is performed to execute a subroutine for a secondary feeding action for positioning the document, fed to the nip site of the resist roller pair 74, at a predetermined position on the transparent panel 8 of the electrostatic copying machine 2.

Then, the control means 100 goes to step S3 to make sure that a document change signal has been sent from the control means 200 of the electrostatic copying machine 2. This document change signal is sent from the control means 200 of the electrostatic copying machine 2 to the control means 100 when exposure of the document delivered onto the transparent panel 8 is completed. If no document change signal is present at step S3, exposure of the document delivered onto the transparent panel 8 has not been completed yet, and the procedure is put in the wait state. When there is a document change signal, step S4 is performed to drive the electric motors 510 (M2) and 520 (M3), actuating the conveying belt mechanism 76 constituting the document conveying means and the delivery roller pairs 82, 84 and discharge roller pair 86 constituting the document discharge means. By this action, the document delivered onto the transparent panel 8 and exposed is conveyed through the document sending-out path 80. The control means 100 having driven the electric motors 510 (M2) and 520 (M3) at step S4 moves to step S5 to check whether the discharged document detecting sensor 800 (SW5) is ON, namely, whether the front end of the document to be discharged has reached the position of the discharged document detecting sensor 800 (SW5). If the discharged document detecting sensor 800 (SW5) is not ON at step S5, the front end of the document has not reached the discharged document detecting sensor 800 (SW5). Thus, the control means 100 goes into the wait state. When the discharged document detecting sensor 800 (SW5) is ON, the control means 100 judges that the front end of the document has reached the position of the discharged document detecting sensor 800 (SW5). Thus, the control means 100 proceeds to step S6, starting counting pulse signals (PS) from the rotational amount detecting means 521 (FG3) mounted on the electric motor 520 (M3). Then, the control means 100 goes to step S7 to check whether the counted value (PSN) of pulse signals (PS) from the rotational amount detecting means 521 (FG3) has reached the set value (N1). The set value (N1) is set at the number of pulse signals corresponding to the amount of conveyance from the arrival of the front end of the document at the position of the discharged document detecting sensor 800 (SW5) until a time immediately before the front end of the document gets to the document table 12. If the counted value (PSN) of pulse signals (PS) does not reach the set value (N1) at step 7, a wait state takes place. When the counted value (PSN) of pulse signals (PS) has reached the set value (N1), the control means 100 goes to step S8 to check whether the third document detecting sensor 27 (SW3) is OFF, namely, whether no document is present on the document table 12 and on the feed belts 32 of the vacuum separating/feeding means 24. As a means of detecting the absence or presence of a document on the document table 12, there may be used a detection signal from the first document detecting sensor 21 (SW1) as a document setting sensor. When, at step S8, the third document detecting sensor 27 (SW3) is not OFF, and documents are present on the document table 12, there is no problem. In this state unchanged, the first document is discharged. If, at step S8, the third document detecting sensor 27 (SW3) is OFF, a judgment is made that no documents are present on the document table 12. The control means 100 moves to step S9 to drive the electric motor 500 (M1) and energize the electromagnetic clutch 35 (CLT1). Thus, the feed belts 32 of the vacuum separating/feeding means 24 are actuated. Even if the front end of the discharged document contacts the feed belts 32, this front end is not snagged, since the feed belts 32 move in the document conveying direction. On this occasion, it is desirable to control voltage supplied to the electric motor 500 (M1), thereby controlling the rotational speed of the electric motor 500 (M1), in order that the moving speed of the feed belts 32 is equal or nearly equal to the delivery speed of the document discharged. Generally, the document discharge speed of the discharge roller pair 86 is higher than the document delivery speed of the feed belts 32. A great difference between these speeds may result in snagging of the front end of the discharged document, even when the feed belts 32 are in operation. Thus, it is desirable to control the electric motor 500 (M1) so that the moving speed of the feed belts 32 may be nearly equal to the document discharge speed of the discharge roller pair 86.

After driving the electric motor 500 (M1) and energizing the electromagnetic clutch 35 (CLT1) at step S9, the control means 100 moves to step S10 to check whether the discharged document detecting sensor 800 (SW5) is OFF, namely, whether the rear end of the document to be discharged has reached the position of the discharged document detecting sensor 800 (SW5). If the discharged document detecting sensor 800 (SW5) is not OFF at step S10, the rear end of the document has not reached the discharged document detecting sensor 800 (SW5). Thus, the control means 100 goes into the wait state. When the discharged document detecting sensor 800 (SW5) is OFF, the control means 100 judges that the rear end of the document has passed the discharged document detecting sensor 800 (SW5). Thus, the control means 100 moves to step S11, setting the timer 104 (T) at T1. The set time T1 is the time from the passage of the rear end of the document beside the discharged document detecting sensor 800 (SW5) until the passage of this rear end through the discharge roller pair 86. This set time T1 is set, for example, at 100 msec. After setting the timer 104 (T) at T1 at step S11, the control means 100 goes to step S12 to check whether the time TS elapsing after the rear end of the document has passed the discharged document detecting sensor 800 (SW5) has reached the set time T1. If the elapsing time TS has not reached the set time T1, a document discharge action continues. If the elapsing time TS has reached the set time T1, a judgment is made that the rear end of the document has passed through the discharge roller pair 86. Then, the control means 100 moves to step S13 to turn off the electric motors 500 (M1), 510 (M2) and 520 (M3) and deenergize the electromagnetic clutch 35 (CLT1).

In the document separating/feeding mechanism of an automatic document conveying device according to the first aspect of the present invention, when documents of a large width are placed on the document table, the feed drum disposed beside the vacuum separating/feeding means is actuated. The vacuum separating/feeding means and the feed drum feed the lowermost, first document while sucking it in its entire widthwise direction. Thus, oblique feeding of the document is prevented reliably.

According to this aspect of the invention, the duct comprises a suction portion to be inserted into the feed drum, and a connecting portion, the suction portion has an opening on an upper side thereof, and an upper end side of a side wall constituting the opening adjoins the inner peripheral surface of the feed drum. Thus, each of the plurality of holes formed in the feed drum opposes the opening of the duct and communicates with the duct, only when these holes are positioned upwardly. Hence, when each of the plurality of holes formed in the feed drum is positioned upwardly and opposes the opening of the duct, the document is present above in a sucked state. The holes not opposing the opening of the duct do not communicate with the duct, thus minimizing leakage of vacuum.

This aspect of the invention also provides a document detecting means for detecting whether documents of a large width are placed on the document table or not. When the document detecting means detects the document, communication is established between the vacuum chamber constituting the vacuum separating/feeding means and the feed drum. Whereas when the document detecting means does not detect the document, communication between the vacuum chamber and the feed drum is cut off. Thus, in case the width of documents placed on the document table is small, the degree of vacuum within the vacuum chamber of the vacuum separating/feeding means does not lower through the feed drum.

In the above aspect of the invention, moreover, the drive means for rotationally driving the feed drum is provided with an electromagnetic clutch. When the document detecting means does not detect the document, the electromagnetic clutch is deenergized, and the feed drum is stopped. Thus, the feed drum does not rotate without bearing the document thereon, so that safety can be ensured.

In the document separating/feeding mechanism of an automatic document conveying device according to the second aspect of the present invention, ribs are provided in the opening of the vacuum chamber constituting the vacuum separating/feeding means, the ribs being disposed obliquely with respect to the document conveying direction and slightly protruding from the upper surface of the vacuum chamber. The feed belts wound round the vacuum chamber and passed on its upper surface are deformed in wavy form by the ribs. Thus, air easily enters between the lowermost, first document and the second or later document placed on the document table, ensuring separation of the lowermost document. When the lowermost, first document suction-attached to the feed belts is fed to the downstream side in the conveying direction, protrusions of the feed belts by the ribs provided obliquely with respect to the document conveying direction are formed in the entire widthwise direction, even if the second or later document is not floated by air. Thus, a rub between the lowermost, first document and the second or later document by the protrusions of the feed belts does not concentrate in a particular site, but disperses, thus diminishing a stain of the document. The ribs formed in the openings of the vacuum chamber are provided obliquely with respect to the document conveying direction, so that the feed belts contact the ribs over a widthwise broad range. Consequently, wear only of particular sites is prevented.

In the automatic document conveying device according to the third aspect of the invention, when the document detection sensor produces a signal for the absence of a document on the document table during discharge of the first document, which has been fed by the vacuum separating/feeding means after setting on the document table, by the document discharge means, the feed motor is driven to move the feed belts of the vacuum separating/feeding means. Thus, the front end of the document discharged is not snagged on the feed belts.

According to this aspect of the invention, the control means drives and controls the feed motor so that the moving speed of the feed belts becomes nearly equal to the document discharge speed by the document discharge means. Thus, the front end of the discharged document can be reliably prevented from being snagged on the feed belts.

According to the fourth aspect of the invention, a document load detecting means for detecting the load of the set documents placed on the document table includes a detector member having a detection portion which contacts the set document placed on the document table, the detection portion being disposed between the set document stopper and the discharged document stopper. The document returned onto the set documents after the set documents have been fed does not contact the detection portion of the detector member. This can prevent poor stock or jam occurring because the document returned onto the set documents contacts the detection portion of the detector member and bends. Accordingly, a thin paper with weak nerve can be used.

According to the fifth aspect of the invention, the set document stopper and the discharged document stopper are disposed above the document table. They are moved in the following manner by the stopper moving means which comprises one driving means, and a moving mechanism for moving the set document stopper and the discharged document stopper by the driving force of the driving means: When moving the set document stopper from the stop position to the retreat position, the stopper moving means moves the discharged document stopper from the retreat position to the restraint position, while when moving the set document stopper from the retreat position to the stop position, the stopper moving means moves the discharged document stopper from the restraint position to the retreat position. Since the set document stopper and the discharged document stopper can be moved by the single stopper moving means in this manner, an inexpensive automatic document conveying device is obtained by the invention.

Also, the moving mechanism of the stopper moving means comprises a moving shaft rotated by the driving means through a predetermined angle; a moving cam mounted on the moving shaft and engaging the set document stopper to move the set document stopper; and a moving lever mounted on the moving shaft and engaging the discharged document stopper to move the discharged document stopper. Hence, it is compact-structured, and can be easily disposed upward of the document table.

According to the sixth aspect of the invention, the set document stopper, the discharged document stopper, and the detector member constituting the document load detecting means are disposed above the document table. They are moved in the following manner by the stopper moving means which comprises one driving means, and a moving mechanism for moving the set document stopper and the discharged document stopper by the driving force of the driving means: When moving the set document stopper from the stop position to the retreat position, the stopper moving means moves the discharged document stopper from the retreat position to the restraint position and also moves the detection portion of the document load detecting means from the retreat position to the detection position, while when moving the set document stopper from the retreat position to the stop position, the stopper moving means moves the discharged document stopper from the restraint position to the retreat position and also moves the detection portion of the document load detecting means from the detection position to the retreat position. In this manner, the detection portion of the document load detecting means can also be moved by the single moving means which moves the set document stopper and the discharged document stopper. Thus, an even less expensive automatic document conveying device is obtained by the invention. When the set document stopper is moved from the retreat position to the stop position, the discharged document stopper from the restraint position to the retreat position, and the detection portion of the document load detecting means from the detection position to the retreat position, all by the single stopper moving means, after the set documents are all fed and returned onto the document table, the front end of the discharged document contacts the discharged document stopper. Its frictional load may make the discharged document stopper poorly movable. At this time, the detection portion of the document load detecting means is not moved to the predetermined retreat position. Thus, the poor movability of the discharged document stopper can be detected. According to this invention, the set document stopper, the discharged document stopper, and the detector member constituting the document load detecting means are adapted to be moved by the single stopper moving means. Hence, the movement of the set document stopper and the discharged document stopper can be confirmed by the document load detecting means.

Furthermore, the moving mechanism of the stopper moving means comprises a moving shaft rotated by the driving means through a predetermined angle; a moving cam mounted on the moving shaft and engaging the set document stopper to move the set document stopper; a moving lever mounted on the moving shaft and engaging the discharged document stopper to move the discharged document stopper; and a moving lever mounted on the moving shaft and engaging the detector member constituting the document load detecting means to move the detector member. Hence, it is compact-structured, and can be easily disposed upward of the document table.

According to the seventh aspect of the invention, a set document stopper for positioning the front ends of the documents placed on the document table is disposed above the document table, and is movable between a stop position where the lower end of the set document stopper contacts the upper surface of the document table, and a document separation position where the lower end of the set document stopper is spaced upward from the upper surface of the document table with a predetermined spacing; and the stopper moving means brings the set document stopper to the stop position when setting documents, and brings the set document stopper to the document separation position when feeding documents. Thus, when air is jetted by the separating air jetting means toward the front ends of the set documents during document feeding, air is injected between the documents, whereby the respective documents are separated. Moreover, the second or later documents have their front end parts floated upward of the lower end of the set document stopper. Hence, their movement toward the downstream side in the document conveying direction is restrained, and their dragged overlap feed is prevented. In the present invention, the set document stopper has such a document dragged overlap feed preventing function. Since there is no need to provide a document separating member anew, an inexpensive automatic document conveying device can be obtained.

What we claim is:

1. A document separating/feeding mechanism for an automatic document conveying device, said document separating/feeding mechanism comprising:

a document table having a first opening at a front part thereof in the document conveying direction, and vacuum separating/feeding means including a vacuum chamber disposed below said first opening of said document table such that an upper surface thereof is nearly coplanar with the upper surface of said document table, the upper surface of said vacuum chamber having an opening; a drive roller and a driven roller disposed parallel to each other ahead of and behind said vacuum chamber in the document conveying direction; and a feed belt passed over said drive roller, said driven roller and said vacuum chamber and having a plurality of holes; wherein said document table has a second opening laterally of a front part of said first opening in the document conveying direction, and said document separating/feeding mechanism further includes a feed drum disposed below said second opening of said document table such that an outer peripheral surface thereof is situated slightly above the upper surface of said document table; driving means for rotationally driving said feed drum at nearly the same peripheral speed as the moving speed of said feed belt; a duct for connecting said feed drum and said vacuum chamber; and opening/closing means for making said vacuum chamber and said feed drum communicate with each other via said duct or cut off from each other.

2. The document separating/feeding mechanism for an automatic document conveying device of claim 1, wherein said duct comprises a suction portion to be inserted into said feed drum, and a connecting portion, the suction portion has an opening on an upper side thereof, an upper end side of a side wall constituting said opening adjoins the inner peripheral surface of said feed drum.

3. The document separating/feeding mechanism for an automatic document conveying device of claim 1, said document separating/feeding mechanism further including document detecting means for detecting whether the document placed on said document table is situated above said second opening or not, wherein when said document detecting means detects the document, said opening/closing means establishes communication between said vacuum chamber and said feed drum, whereas when said document detecting means does not detect the document, said opening/closing means cuts off communication between said vacuum chamber and said feed drum.

4. The document separating/feeding mechanism for an automatic document conveying device of claim 3, wherein said drive means is provided with an electromagnetic clutch, and when said document detecting means detects the document, said electromagnetic clutch is energized, whereas when said document detecting means does not detect the document, said electromagnetic clutch is deenergized.

* * * * *